US011401838B2

(12) United States Patent
Gron, Jr. et al.

(10) Patent No.: US 11,401,838 B2
(45) Date of Patent: Aug. 2, 2022

(54) ROTATING ACTUATOR SYSTEM FOR CONTROLLING VALVE ACTUATION IN AN INTERNAL COMBUSTION ENGINE

(71) Applicant: Jacobs Vehicle Systems, Inc., Bloomfield, CT (US)

(72) Inventors: G. Michael Gron, Jr., Granby, CT (US); Jacob Moore, Cromwell, CT (US); Justin D. Baltrucki, Canton, CT (US); Eric J. Hodgkinson, New Hartford, CT (US); Timothy P. Neal, Harwinton, CT (US); Bruce A. Swanbon, Tolland, CT (US); Robb Janak, Bristol, CT (US); Matei Alexandru, Somers, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 17/457,574

(22) Filed: Dec. 3, 2021

(65) Prior Publication Data

US 2022/0178279 A1 Jun. 9, 2022

Related U.S. Application Data

(60) Provisional application No. 63/199,030, filed on Dec. 3, 2020.

(51) Int. Cl.
*F01L 1/18* (2006.01)
*F01L 1/46* (2006.01)

(52) U.S. Cl.
CPC ..... *F01L 1/18* (2013.01); *F01L 1/462* (2013.01)

(58) Field of Classification Search
CPC ..... F01L 1/18; F01L 1/462; F01L 1/182
See application file for complete search history.

(56) References Cited

U.S. PATENT DOCUMENTS 4,340,017 A 7/1982 Kato et al.
4,543,927 A 10/1985 Luhn et al.
(Continued)

FOREIGN PATENT DOCUMENTS

DE 102016205790 A1 10/2017
DE 102017008219 A1 2/2019
(Continued)

OTHER PUBLICATIONS

International Search Report for International Application No. PCT/IB2021/061332 dated Jan. 11, 2022, 3 pages.
(Continued)

*Primary Examiner* — Zelalem Eshete
(74) *Attorney, Agent, or Firm* — Moreno IP Law LLC

(57) ABSTRACT

A system for controlling actuation of an engine valve comprises a pivot and a torsion spring having first and second legs operatively connected to the pivot. A lever arm is adjustably affixed to and extending away from the pivot, and is further rotatable about a pivot axis of the pivot between a retracted position and an extended position and vice versa relative to a motion conveying component. Furthermore, a housing is provided having a pivot bore formed therein with the pivot rotatably disposed in the pivot bore. The housing further comprises a first and second openings intersecting with the pivot bore such that the first and second legs extend out of the first opening and the lever arm extends out of the second opening. When a first force is applied by the motion conveying component to the lever arm, such first force maintains the lever arm in the extended position.

11 Claims, 21 Drawing Sheets

(56) References Cited

U.S. PATENT DOCUMENTS

| | | | | |
|---|---|---|---|---|
| 6,343,582 | B1 | 2/2002 | Peng | |
| 6,467,443 | B1 | 10/2002 | Tsuruta et al. | |
| 6,848,407 | B2 | 2/2005 | Kobayashi et al. | |
| 7,011,062 | B2 | 3/2006 | Sanada et al. | |
| 7,063,068 | B2 | 6/2006 | Katsuhiko et al. | |
| 7,263,960 | B2 | 9/2007 | Saito et al. | |
| 7,392,772 | B2 | 7/2008 | Janak et al. | |
| 7,789,065 | B2 | 9/2010 | Yang | |
| 7,909,017 | B2 | 3/2011 | Yang | |
| 8,061,311 | B2 | 11/2011 | Nakamura | |
| 8,307,806 | B2 | 11/2012 | Mariano et al. | |
| 9,410,455 | B2 | 8/2016 | Gron et al. | |
| 2001/0035140 | A1* | 11/2001 | Fernandez | F01L 1/185 123/90.15 |
| 2004/0221824 | A1 | 11/2004 | Denteler et al. | |
| 2006/0016408 | A1 | 1/2006 | Gaubatz et al. | |
| 2006/0185638 | A1 | 8/2006 | Saito et al. | |
| 2008/0121477 | A1 | 5/2008 | Bianchi | |
| 2010/0077980 | A1 | 4/2010 | Havlik et al. | |
| 2012/0279463 | A1 | 11/2012 | Moller | |
| 2013/0068195 | A1 | 3/2013 | Ruggiero et al. | |
| 2013/0180485 | A1 | 7/2013 | Kamio | |
| 2013/0233260 | A1 | 9/2013 | Jocsak et al. | |

FOREIGN PATENT DOCUMENTS

| | | | |
|---|---|---|---|
| JP | S58174110 | A | 10/1983 |
| JP | S59180019 | A | 10/1984 |
| JP | 2001263018 | A | 9/2001 |
| JP | 2002242628 | A | 8/2002 |
| WO | 2007064901 | A2 | 6/2007 |
| WO | 2009106950 | A | 9/2009 |
| WO | 2020048639 | A1 | 3/2020 |

OTHER PUBLICATIONS

Written Opinion of the International Searching Authority for International Application No. PCT/IB2021/061332 dated Jan. 11, 2022, 3 pages.

* cited by examiner

-Prior Art-

-Prior Art-

ROTATING ACTUATOR SYSTEM FOR CONTROLLING VALVE ACTUATION IN AN INTERNAL COMBUSTION ENGINE

FIELD

The present disclosure relates generally to internal combustion engines and, in particular, to rotating actuator systems for controlling valve actuation in such internal combustion engines.

BACKGROUND

Actuators are well-known in the art and may comprise various devious configured to effectuate the movement and/or operation of another mechanism. For example, in the field of internal combustion engines, actuators often comprise a piston capable of maintaining two positions: a spring-biased retracted state in which the piston does not affect the movement/operation of another mechanism and a hydraulically-controlled extended state in which the piston does affect the movement/operation of the other mechanism.

An example of such an internal combustion engine is shown in FIG. 1, which is a partial schematic illustration of an internal combustion engine 100 including a cross-sectional view of an engine cylinder 102 and related valve actuation systems in accordance with the instant disclosure. Although a single cylinder 102 is illustrated in FIG. 1, this is only for ease of illustration and it is appreciated that internal combustion engines often include multiple such cylinders driving a crankshaft (not shown). The engine cylinder 102 has disposed therein a piston 104 that reciprocates upward and downward repeatedly during both positive power operation (i.e., combustion of fuel to drive the piston 104 and the drivetrain) and engine braking operation (i.e., use of the piston 104 to achieve air compression and absorb power through the drivetrain) of the cylinder 102. At the top of each cylinder 102, there may be at least one intake valve 106 and at least one exhaust valve 108 that are continuously biased into their respective closed positions by corresponding valve springs 105, 107. The intake valve(s) 106 and the exhaust valve(s) 108 are opened and closed to provide communication with an intake gas passage 110 and an exhaust gas passage 112, respectively. Valve actuation forces to open the intake valve 106 and exhaust valve 108 are conveyed by respective valve trains 114, 116. In turn, such valve actuation forces (illustrated by the dashed arrows) may be provided by respective main and/or auxiliary motion sources 118, 120, 122, 124 such as rotating cams. As used herein, the descriptor "main" refers to so-called main event engine valve motions, i.e., valve motions used during positive power generation, whereas the descriptor "auxiliary" refers to other engine valve motions for purpose other than positive power generation (e.g., compression release braking, bleeder braking, cylinder decompression, brake gas recirculation (BGR), etc.) or in addition to positive power generation (e.g., internal exhaust gas recirculation (IEGR), variable valve actuations (VVA), Miller/Atkinson cycle, swirl control, etc.).

The valve trains 114, 116 may include any number of mechanical, hydraulic, hydro-mechanical, electromagnetic, or other type of valve train elements known in the art. For example, each of the valve trains 114, 116 may include one or more cam followers, push tubes, rocker arms, valve bridges, etc. used to transfer valve actuation motion to the valves 106, 108. Additionally, one or more actuators 126, 128 may be included in either or both valve trains 114, 116 whereby valve actuation motions typically conveyed by the valve trains 114, 116 are partially controlled or modified. Typically, such actuators 126, 128 are under control of corresponding actuator controllers 130, 132 (such as solenoids controlling hydraulic fluid, electromagnetic linear actuators, etc.) that, in turn, are controlled by an engine controller 134, which may comprise any electronic, mechanical, hydraulic, electrohydraulic, or other type of control device for communicating with and controlling operation of the actuator controllers 130, 132. For example, the engine controller 134 may be implemented by a microprocessor and corresponding memory storing executable instructions used to implement the required control functions, as known in the art. It is appreciated that other functionally equivalent implementations of the engine controller 134, e.g., a suitable programmed application specific integrated circuit (ASIC) or the like, may be equally employed. A particular function employing such actuators is cylinder decompression or bleeder braking, though those skilled in the art will appreciate that other applications are well known.

FIGS. 2 and 3A-C are schematic illustrations of a rotating actuator used in internal combustion engines in accordance with prior art techniques. For example, U.S. Pat. No. 4,340,017 illustrates an example of such a rotating actuator used for cylinder decompression. As shown in FIG. 2, a valve train 200 comprises a motion source 202, motion conveying components 208 and one more engine valves 210 as known in the art. As further shown, a rotating actuator 206 is supported by a fixed object 204 relative to the motions conveyed by/movements of the motion conveying components 208. In this case, the rotating actuator 206 is operated to selectively maintain a motion conveying component 208 is a desired position (or not, as the case may be) to thereby control the engine valves 210, e.g., in an open position as in the case of cylinder decompression or bleeder engine braking.

Operating principles of a rotating actuator of the type described in the '017 patent are further described relative to FIGS. 3A-C. In particular, a rotating actuator 300 comprises a rotatable pivot 302 having a rotation axis 304. Additionally, the rotating actuator 300 comprise a lever arm 306 affixed on the pivot 302. In this example, an outer edge of the pivot 302 is maintained at a distance D away from a movable component 308 (e.g., a motion conveying component of a valve train). A portion of the lever arm 306 extends by a length X beyond the outer edge of the pivot 302, where X>D. In the illustrated example, the movable component 308 comprises a piston residing in a bore 310 defined in a housing 312, however, those skilled in the art will appreciate that the movable component 308 need not be limited to the illustrated piston arrangement and may take any of a wide variety of forms. As shown in FIG. 3A, the pivot 302 and lever arm 306 are rotated about the axis 304 at an angle $\theta_1>0$ relative to vertical, resulting in establishment of a gap (or lash space) L above an upper surface 309 of the movable component 308 thereby preventing any physical interaction between the actuator 300 and the movable component 308. In this state, the actuator 300 is deemed to be in a "retracted," "off" or "deactivated" state.

FIG. 3B, on the other hand, illustrates interaction between the actuator 300 and the movable component 308 when the rotatable pivot 302 and lever arm 306 have been rotated 320 such that the lever arm 306 is vertically oriented, i.e., $\theta_2=0$. In this state, the actuator 300 is deemed to be in an "extended," "on" or "activated" state. When the lever arm 306 is vertically oriented as shown, contact between the lever arm 306 and movable component 308 results in a maximum linear displacement 322 equal to the difference between the lever arm length 306 and the distance of the pivot 302 from the upper surface 309, i.e., X-D. It will be appreciated that at some angles $\theta_3$, where $\theta_1>|\theta_3|>\theta_2$, the lever arm 306 may be in contact with the upper surface 309 of the moveable component 308 such that the moveable component is still displaced 322 by an amount less than the maximum depicted in FIG. 3B. An example of this is illustrated in FIG. 3C, where the lever arm 306 is rotated by an angle $\theta_3$ that results in a new effective lever arm length $X'=X*\cos(\theta_3)$. To the extent that $X'<X$, the resulting lash space X'-D will also be less than the lash space X-D illustrated in FIG. 3B. As described in greater detail below, such intermediate rotations as shown in FIG. 3C can cause moments to be induced in the actuator 300 that may be exploited to control operation of the actuator 300.

While such actuators have proven useful, further actuator designs would be desirable for varying applications.

SUMMARY

The instant disclosure describes systems for controlling actuation of an engine valve in an internal combustion engine comprising such an engine valve and a valve actuation motion source operatively connected to the engine valve by at least one motion conveying component. In particular, such a system comprises a pivot and a torsion spring having first and second legs operatively connected to the pivot. A lever arm is adjustably affixed to and extending away from the pivot, the lever arm being further rotatable about a pivot axis of the pivot between a retracted position and an extended position and vice versa relative to a motion conveying component. Furthermore, a housing is provided having a pivot bore formed therein with the pivot rotatably disposed in the pivot bore. The housing further comprises a first opening intersecting with the pivot bore and a second opening intersecting with the pivot bore such that the first and second legs extend out of the first opening and the lever arm extends out of the second opening. In the retracted position, the lever arm has substantially no effect on actuation of the engine valve and, in the extended position, the lever arm is positioned to contact the motion conveying component thereby controlling actuation of the engine valve. When a first force is applied by the motion conveying component to the lever arm, such first force maintains the lever arm in the extended position.

In an embodiment, a biasing element is configured to apply a biasing force to rotate the lever arm to the retracted position, wherein the first force applied by the motion conveying component is sufficient to overcome the biasing force applied by the biasing element.

In another embodiment, the second opening in the housing defines a first stop surface and a second stop surface, wherein the first stop surface is configured to delimit the retracted position and the second stop surface is configured to delimit the extended position. In this embodiment, the second stop surface is configured to position the lever at a non-zero angle relative to a direction of application of the first force. Furthermore, the lever arm may comprise a swivel cup disposed on a distal end of the lever arm, wherein the swivel cup is configured to contact the first stop surface when the lever arm is in the retracted position and to contact the second stop surface when the lever arm is in the extended position.

In another embodiment, the first force is a closing force applied by an engine valve spring to the engine valve and, thereby, the motion conveying component.

In yet another embodiment, the system may further comprise a linear actuator having an activated state and a non-activated state, a sliding rack slidably mounted on a fixed housing and operatively connected to the linear actuator and a biasing element configured to bias the sliding rack to a starting position when the linear actuator is in the non-activated state, where the sliding rack moves to a fully displaced position against the bias of the biasing element when the linear actuator is in the activated state. In an implementation, the biasing element may comprise a spring disposed between the linear actuator and the sliding rack. In this embodiment, the first and second legs of the torsion spring are configured to intersect a slot formed in the sliding rack. In the starting position and when the first force is not applied by the motion conveying component to the lever arm, the slot engages the first leg of the torsion spring and positions the lever arm in the retracted position. In the starting position and when the first force is applied by the motion conveying component to the lever arm, the slot induces a load in the first leg of the torsion spring to position the lever arm in the retracted position once the first force is removed from the lever arm. In the fully displaced position and when the first force is not applied by the motion conveying component to the lever arm, the slot engages the second leg of the torsion spring and positions the lever arm in the extended position. Furthermore, in the fully displaced position and when the first force is applied by the motion conveying component to the lever arm, the slot induces a load in the second leg of the torsion spring to position the lever arm in the extended position once the first force is removed from the lever arm. Further still, the slot in the sliding rack may comprise an H-slot having first and second longitudinal channels, wherein the first leg of the torsion spring intersects the first longitudinal channel and the second leg of the torsional spring intersects the second longitudinal channel.

In a presently preferred embodiment, the housing is fixed relative to movement of the motion conveying component. Alternatively, the housing may be provided by another motion conveying component of the at least one motion conveying component.

BRIEF DESCRIPTION OF THE DRAWINGS

The foregoing and other features and advantages will be discussed in detail in the following non-limiting description of specific embodiments in connection with the accompanying drawings, in which.

DETAILED DESCRIPTION OF THE PRESENT EMBODIMENTS

As used herein, phrases substantially similar to "at least one of A, B or C" are intended to be interpreted in the disjunctive, i.e., to require A or B or C or any combination thereof unless stated or implied by context otherwise. Further, phrases substantially similar to "at least one of A, B and C" are intended to be interpreted in the conjunctive, i.e., to require at least one of A, at least one of B and at least one of C unless stated or implied by context otherwise. Further still, the term "substantially" or similar words requiring subjective comparison are intended to mean "within manufacturing tolerances" unless stated or implied by context otherwise. Unless indicated otherwise, reference in this disclosure to absolute positional qualifiers, such as the terms "front," "back," "top," "bottom," "left," "right," etc., or to relative positional qualifiers, such as the terms "above," "below," "higher," "lower," etc., or to qualifiers of orientation, such as "horizontal", "vertical", etc., is made to the orientation shown in the Figures.

Figure 3A:
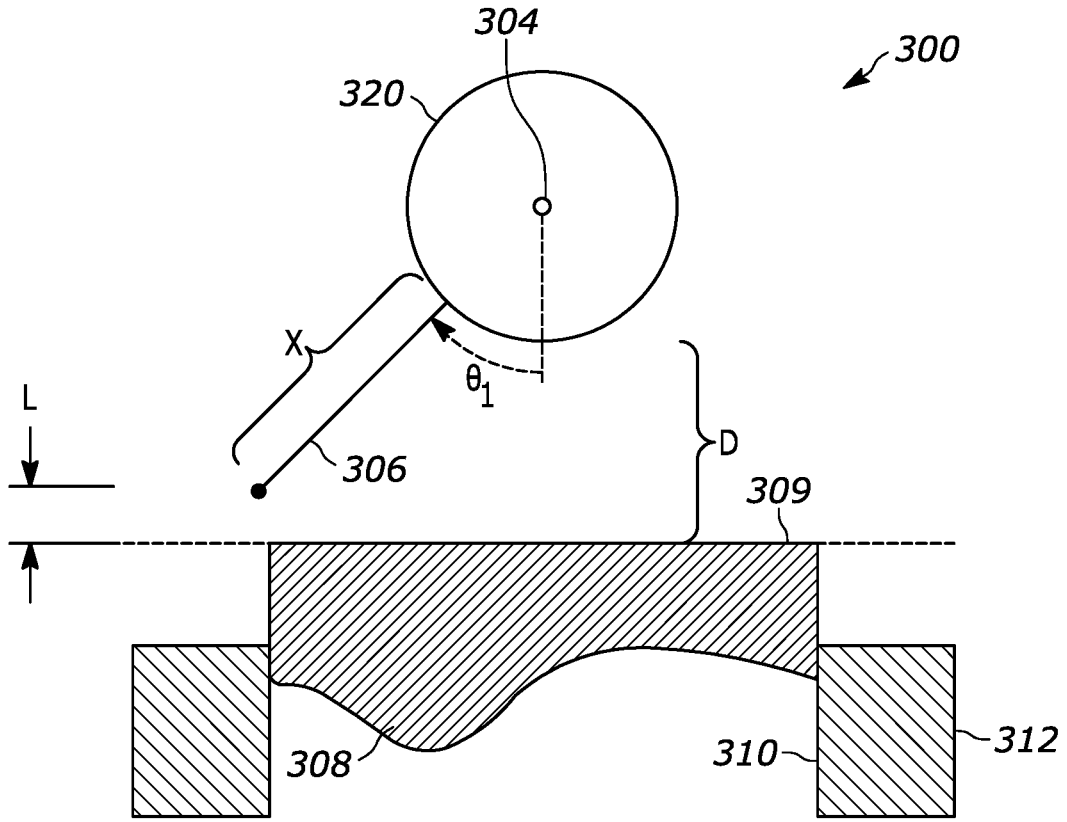
FIGS. 3A-3C schematically illustrate the operational principle of a rotating actuator in accordance with prior art techniques.
Figure 3B:
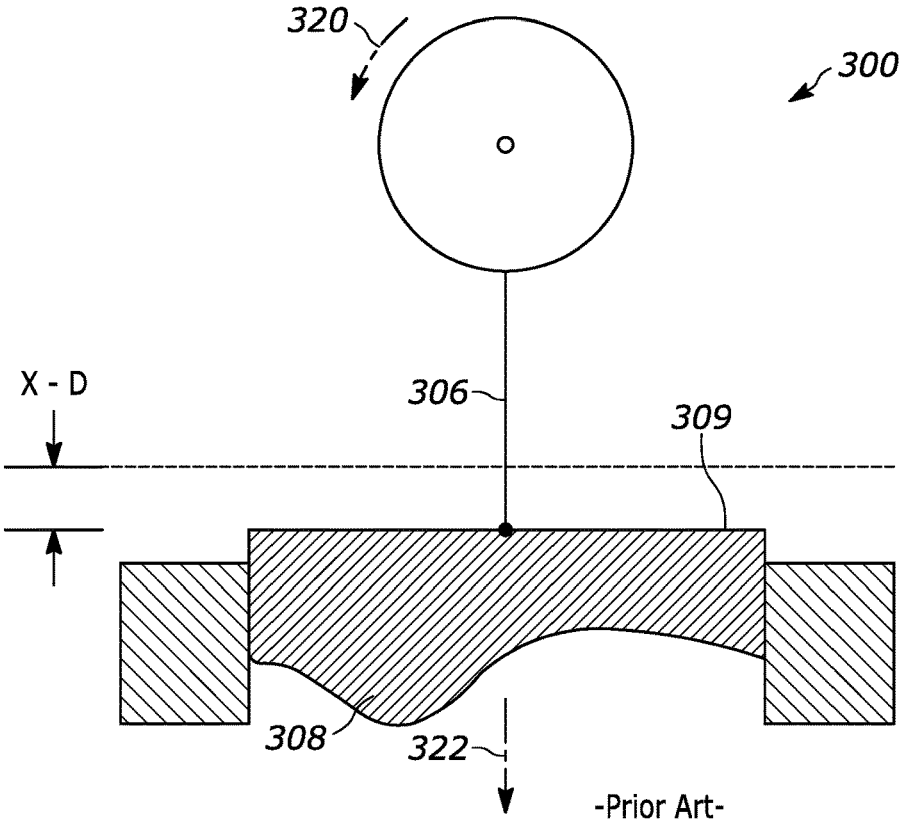
Figure 3C:
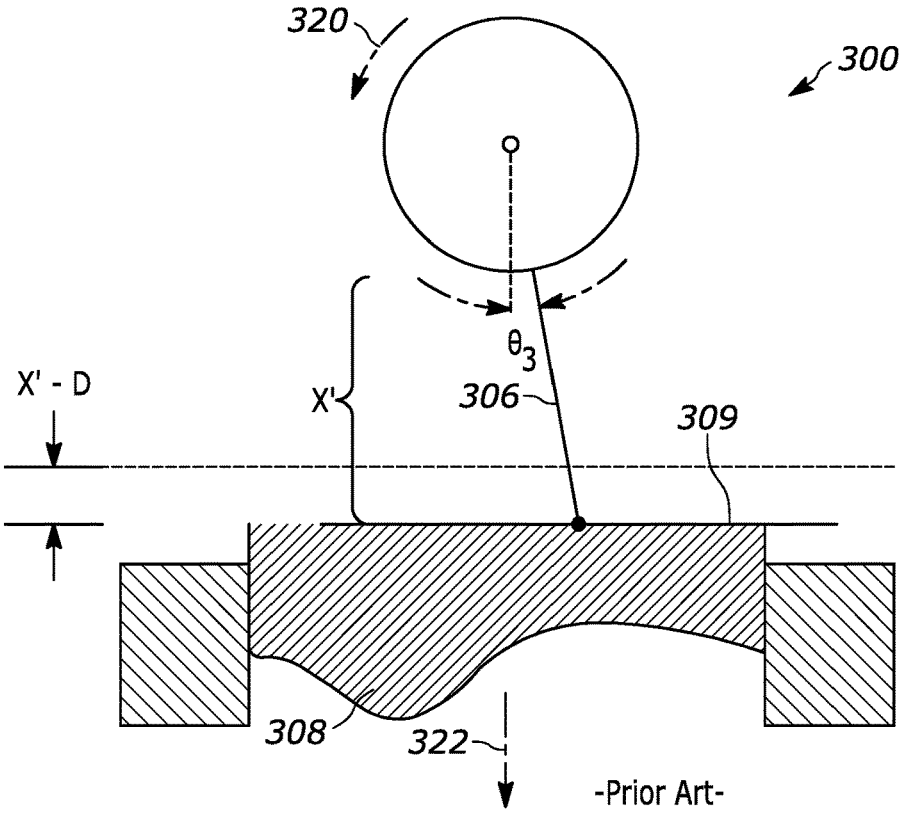
Figure 4A:
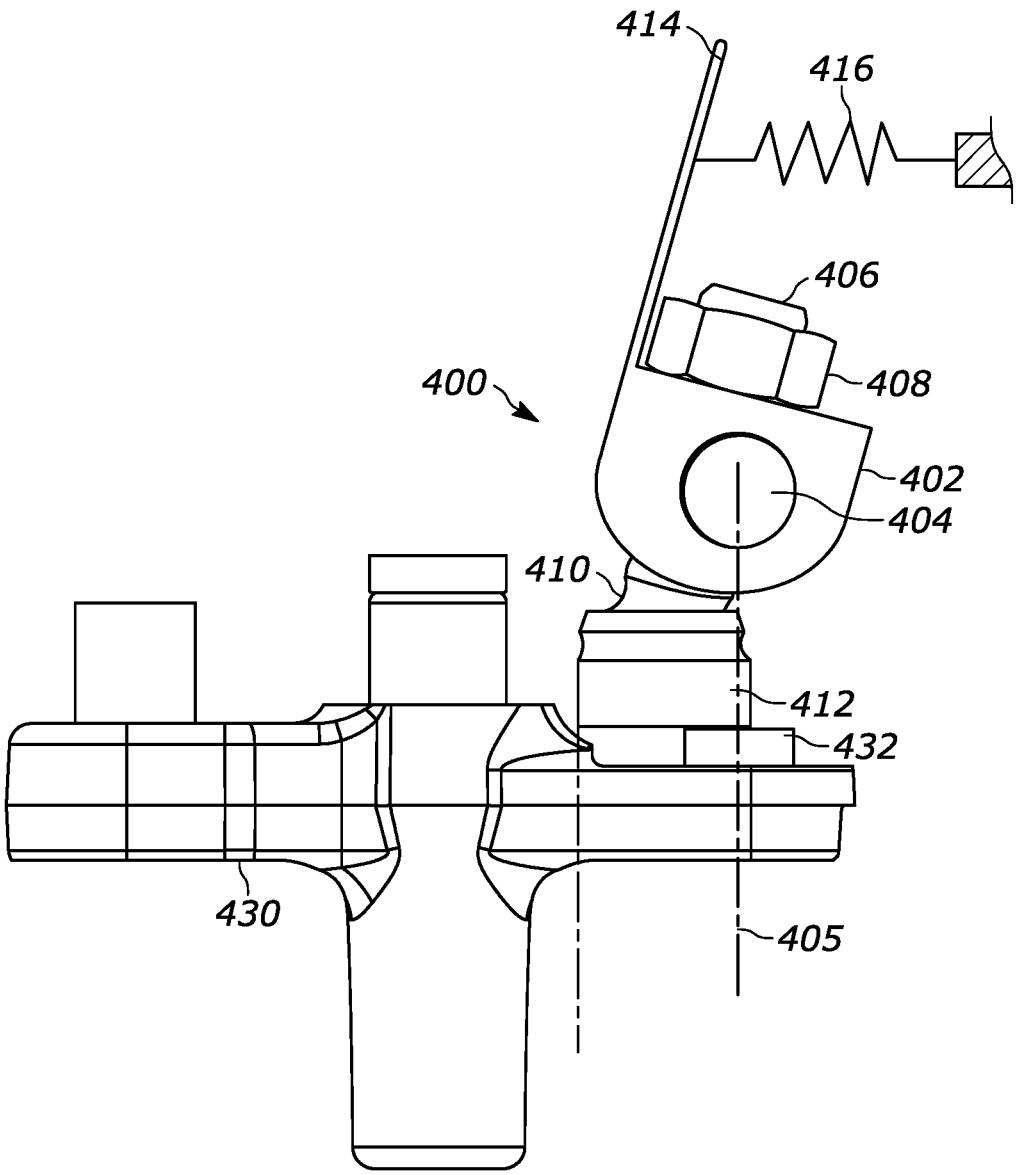
FIGS. 4A and 4B illustrate a first embodiment of a rotating actuator in accordance with the instant disclosure and configured for actuation of an engine valve.
Figure 4B:
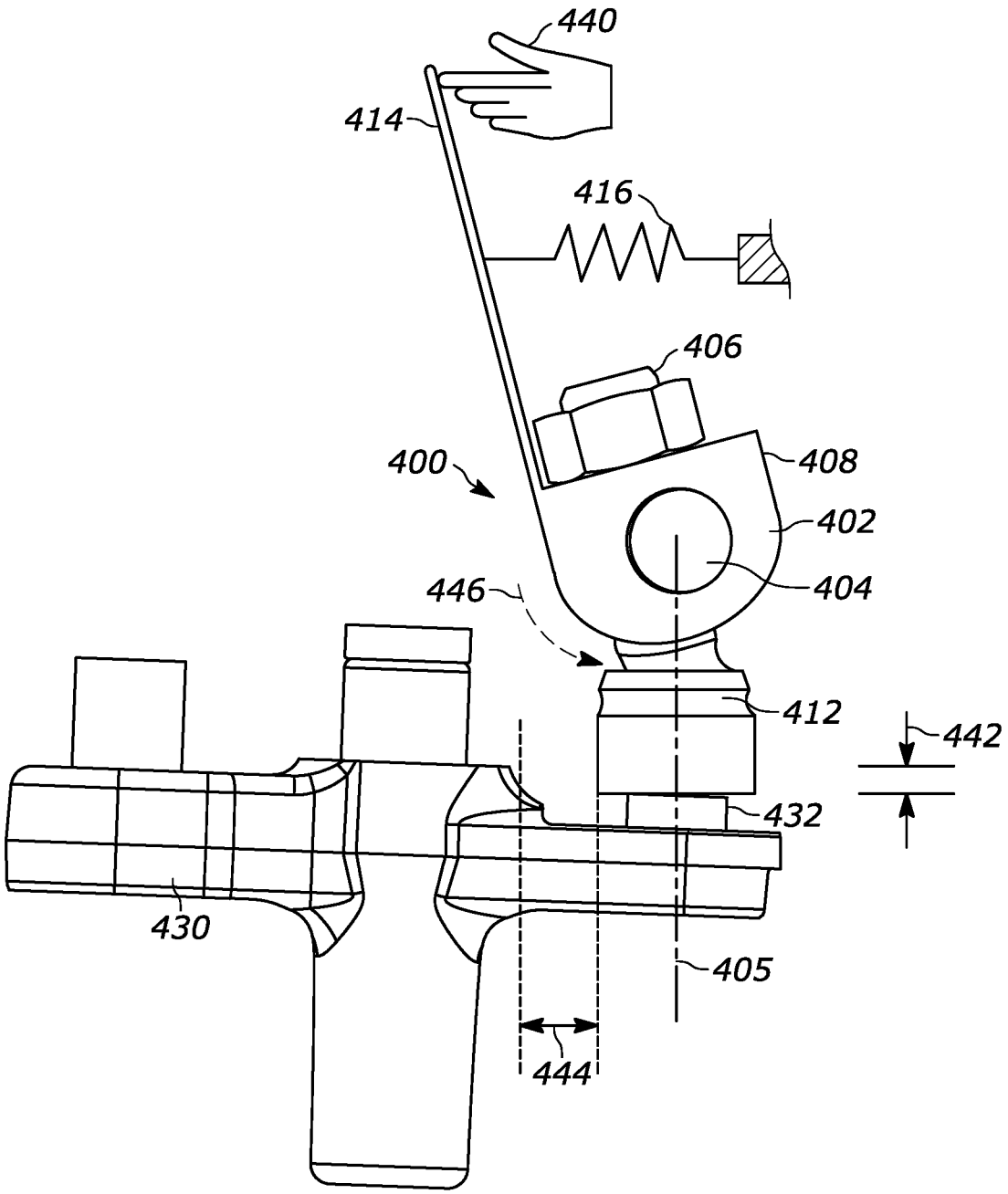

Referring now to FIGS. 4A and 4B, a first embodiment of a rotating actuator 400 is illustrated in connection with a valve bridge 430. In this embodiment, the actuator 400 comprises a pivot body 402 rotatably mounted on a pivot 404. As shown by vertical line 405, a rotational axis of the pivot 404 is aligned with a contact surface 432 formed on the valve bridge 430 and an engine valve (not shown). Similar to the embodiment of FIGS. 3A and 3B, a lever arm 406 is implemented as a lash adjustment screw secured to the housing via a suitably threaded bore formed in the pivot body 402. As known in the art, a lash adjustment screw 408 is provided to fixedly (yet still adjustably) maintain a selected portion 410 of the lash adjustment screw 408 extending out of the pivot body 402 generally in the direction of the valve bridge 430 and contact surface 432. As further shown, a swiveling cup 412, sometimes referred to in the art as an "elephant foot" or "e-foot," is rotatably mounted on a spherical ball end of the lash adjustment screw 406. When the rotating actuator 400 is in the off/retracted/deactivated state shown in FIG. 4A, the swiveling cup 412 may be maintained in contact with the contact surface 432 but not otherwise inducing any movement of the valve bridge 430, as shown, or lash space may be provided as illustrated in the embodiment of FIGS. 3A and 3B. As further shown in FIG. 4A, when the actuator 400 is in the off/retracted/deactivated state, the pivoting cup 412 is laterally offset from the rotational axis of the pivot 404. Rotation of the pivot body 402 may be selected through operation of a second or control lever arm 414 operatively coupled to the pivoting body 402. Additionally, in order to maintain the rotating actuator 400 in the off/deactivated state, a compliant element 416 such as a spring may be provided to bias the control lever arm 414 (in this case, in a clockwise direction as shown).

As shown in FIG. 4B, the rotating actuator 400 may be placed in the on/extended/activated state by application of a suitably strong force 440 to the control lever arm 414, i.e., sufficient to overcome the bias applied by the compliant element 416, thereby causing the pivot body 402 to rotate as shown. In transitioning to the on/extended/activated state, the swiveling cup 412 is laterally displaced 444 to be more aligned with the contact surface 432 as shown. Furthermore, rotation of the lever arm 406, 410 results in a vertical displacement 442 of the contact surface 432 that, in turn, induces a clockwise rotation of the valve bridge 430 (as shown in FIG. 4B). Given the rotation of the control lever arm 414, the resilient element 416 is placed under increased tension that would tend to cause the rotating actuator 400 to rotate back toward the off/retracted/deactivated state illustrated in FIG. 4A. However, in a presently preferred embodiment, the rotation of the lever arm 406, 410 is sufficiently past the vertical (as shown in FIG. 4B) such that a further biasing force applied by the valve springs (not shown) to the valve bridge 430 via intervening engine valves induces a counter-clockwise moment 446. If the moment induced by the valve springs to the lever arm 406, 410 is stronger than the oppositely directed moment induced by the resilient element 416, then the rotating actuator 400 will remain in the on/extended/activated state until such time the valve springs-induced moment 446 is removed from the rotating actuator 400, thereby allowing the resilient element to once again rotate the pivot body 402 and return the rotating actuator 400 to the off/retracted/deactivated state.

Figure 5A:
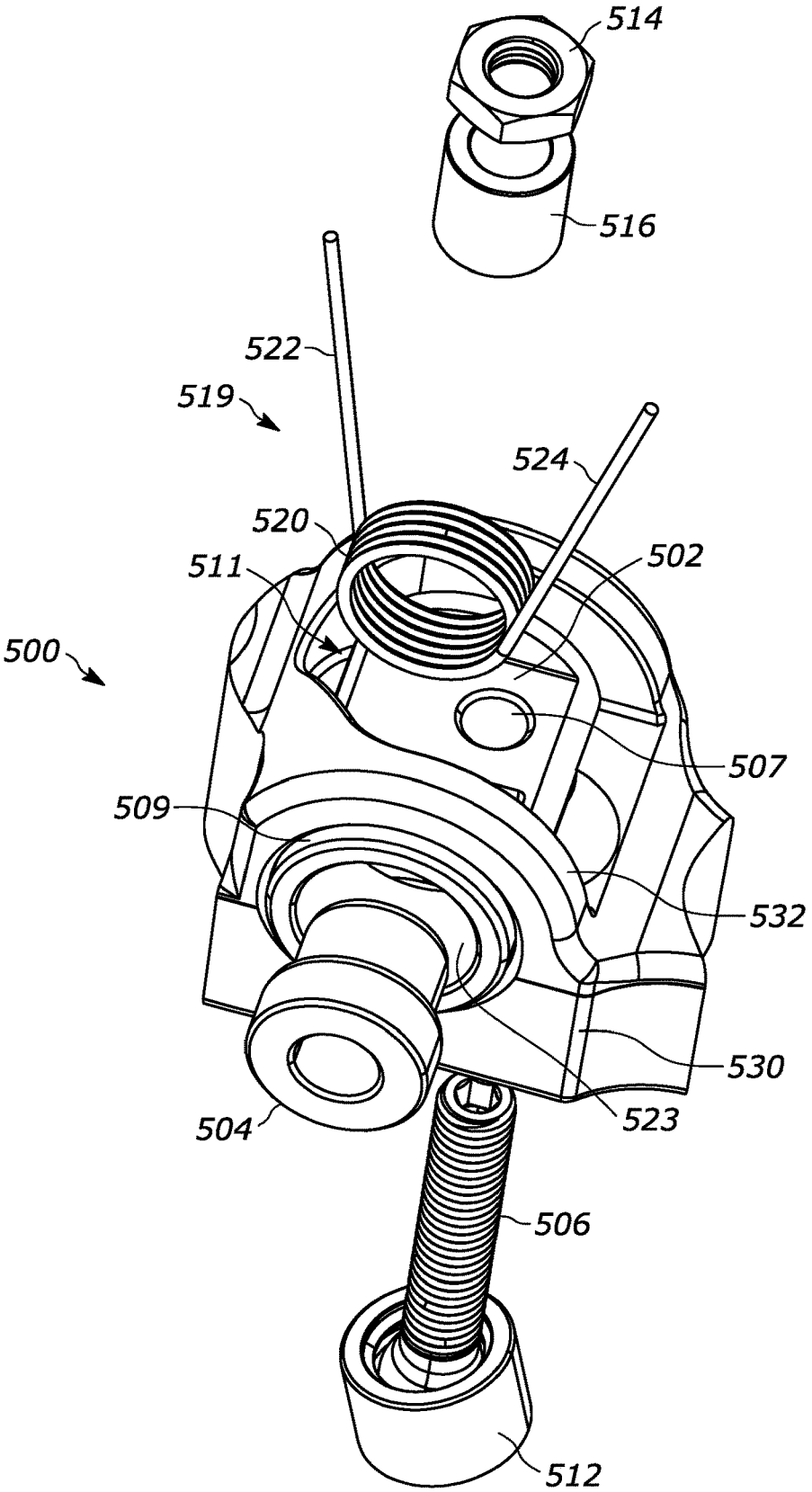
FIGS. 5A and 5B illustrate a second embodiment of a rotating actuator in accordance with the instant disclosure.
Figure 5B:
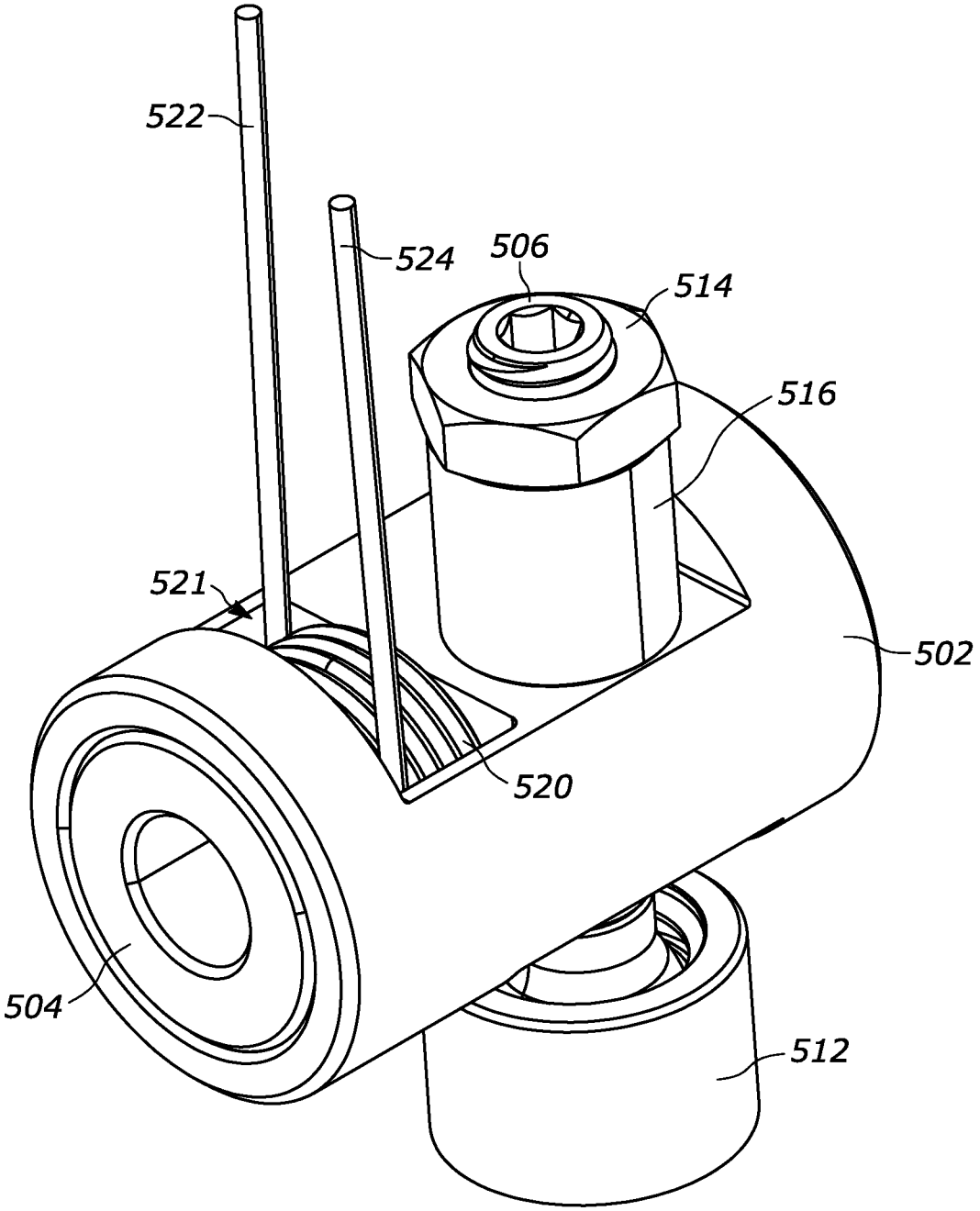

Referring now to FIGS. 5A and 5B, a second embodiment of a rotating actuator 500 is illustrated. In this embodiment, a pivot body 502 rotatably mounted in a housing 530. The housing 530 is preferably a static or fixed body relative to the rotation of the rotating actuator 500 and to any movements of a motion conveying component (e.g., valve bridge, rocker arm, etc.) with which it interacts. For example, in the context of an internal combustion engine, the housing 530 may be integral to or fixedly mounted on a cylinder head or similar structure. Alternatively, in an embodiment described in further detail below, the housing 530 may be integral to a rocker arm or the like.

In the illustrated example, the pivot body 502 is configured to be inserted into a bore 509 formed in the housing 530 such that the pivot body 502 is free to rotate about a central axis of the bore 509. A closed end of the bore 509 limits insertion of the pivot body 502 into the bore. A lever arm 506 in the form of a lash adjustment screw is provided in threaded hole 507 formed in the pivot body 502. As in the embodiment of FIGS. 4A and 4B, the a lash adjustment screw 514 and, in this case, a spacer 516 may be provided to adjust the effective length of the lever arm 506. A first opening 511 in the housing 530 intersects with the bore 509 such that that lever arm 506 may be inserted into the threaded hole 507 once the pivot body is inserted into the bore 509. A second opening 513 (best shown in FIGS. 7 and 10A-10D) is formed on the underside of the housing 530 and intersecting the bore 509 at a point where a spherical ball end of the lever arm 506 emerges from the threaded hole 507. A swiveling cup 512 is provided on the spherical ball end of the lever arm 506. As further shown in FIGS. 10A-10D, the second opening 513 defines a first stop surface 515 and a second stop surface 517 configured to interact with the swiveling cup 512 to limit rotation of the rotating actuator 500 in either direction, as described in further detail below.

A control lever arm 519 is provided in the form of a torsion spring 520. As described in greater detail below, use of the torsion spring 520 creates a compliant control lever arm that partially integrates the function of the resilient element 216 described above relative to FIGS. 4A and 4B. The torsion spring 520 is configured to be inserted in a pocket 521 formed in the pivot body 502 and adjacent to a threaded hole 523 that, in turn, is formed perpendicular to and concentric with a rotational axis of the pivoting body 502. A threaded cap 504 is provided that mates with the threaded hole 523 and includes a longitudinally extending portion that is inserted into a central opening of coils of the torsional spring 520 when the torsional spring 520 is fully inserted into the pocket 521, thereby retaining the torsional spring in the pocket 521. Configured in this manner, first and second legs 522, 524 of the torsional spring 520 extend out of the first opening 511 formed in the housing 530. Abutment of the torsional spring 520 with a lateral wall 532 defined by the first opening 511 prevents the pivot body 502 from escaping the bore 509. As shown in FIG. 5A, the torsional spring 520 is in a free or unloaded state. However, when the torsional spring 520 is inserted into the pocket 521, the confining side walls of the pocket 521 urge the legs 522, 524 inward placing the torsional spring in a preloaded or partially loaded state. As described below, the legs 522, 524 of the torsion spring 520 may be used to control rotation of the pivot body 502 through selective application of forces to either of the legs 522, 524. Moreover, because the legs 522, 524 are compliant, they may be controlled to induce moments in the pivot body 502 that are permitted to cause rotation of the pivot body 502 only when an obstacle (e.g., a movable component to be actuated) to the rotating actuator 500 is moved away.

Figure 6:
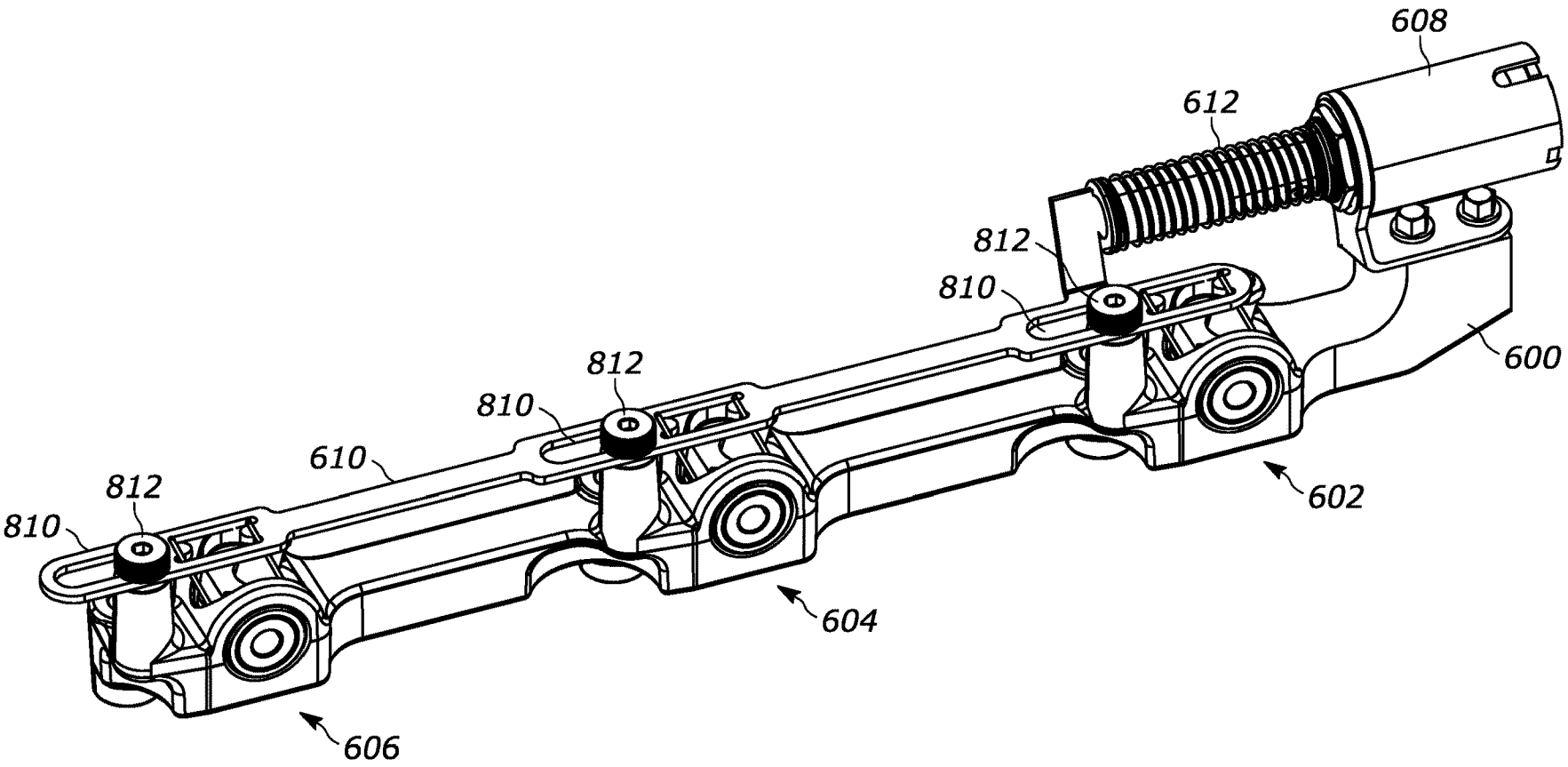
FIGS. 6-8, 9A and 9B are perspective and detailed views of a cylinder decompression system incorporating the second embodiment of the rotating actuator of FIGS. 5A and 5B.

FIGS. 6-9 include various illustrations of a cylinder decompression system incorporating the second embodiment of the rotating actuator of FIGS. 5A and 5B. Although the description provided below is with reference to a decompression system, those skilled in the art will appreciate that the system shown in FIGS. 6-9 may be equally employed for other purposes such as, but not limited to, bleed brake operation. As shown in FIG. 6, the cylinder decompression system comprises a housing 600 having multiple rotating actuators 602-606 deployed therein. In an embodiment, the housing 600 is preferably mounted to a cylinder head such that a swiveling cup 512 of each rotating actuator 602-606 is positioned above a corresponding valve bridge (as illustrated, for example, in FIGS. 4A, 4B and 10A-D) such that the rotating actuators 602-606 may be controlled to actuate the valve bridges in order to maintain the corresponding engine cylinders in a decompressed state. A linear actuator 608 and a sliding rack 610 are also mounted on the housing 600. The linear actuator 608, which may comprise an electromagnetic solenoid or the like, is operatively connected to the rack 610 such that operation of the linear actuator 608 in an activated or energized state causes a displacement of the rack 610 (rightward, as illustrated in FIG. 6). A biasing element 612, in the form of compression spring, is provided between the linear actuator 608 and the rack 610 to induce the opposite displacement of the rack 610 when the linear actuator 608 is in a non-activated or de-energized, i.e., to return the rack 610 to its starting position (leftward) as shown in FIG. 6.

Figure 7:
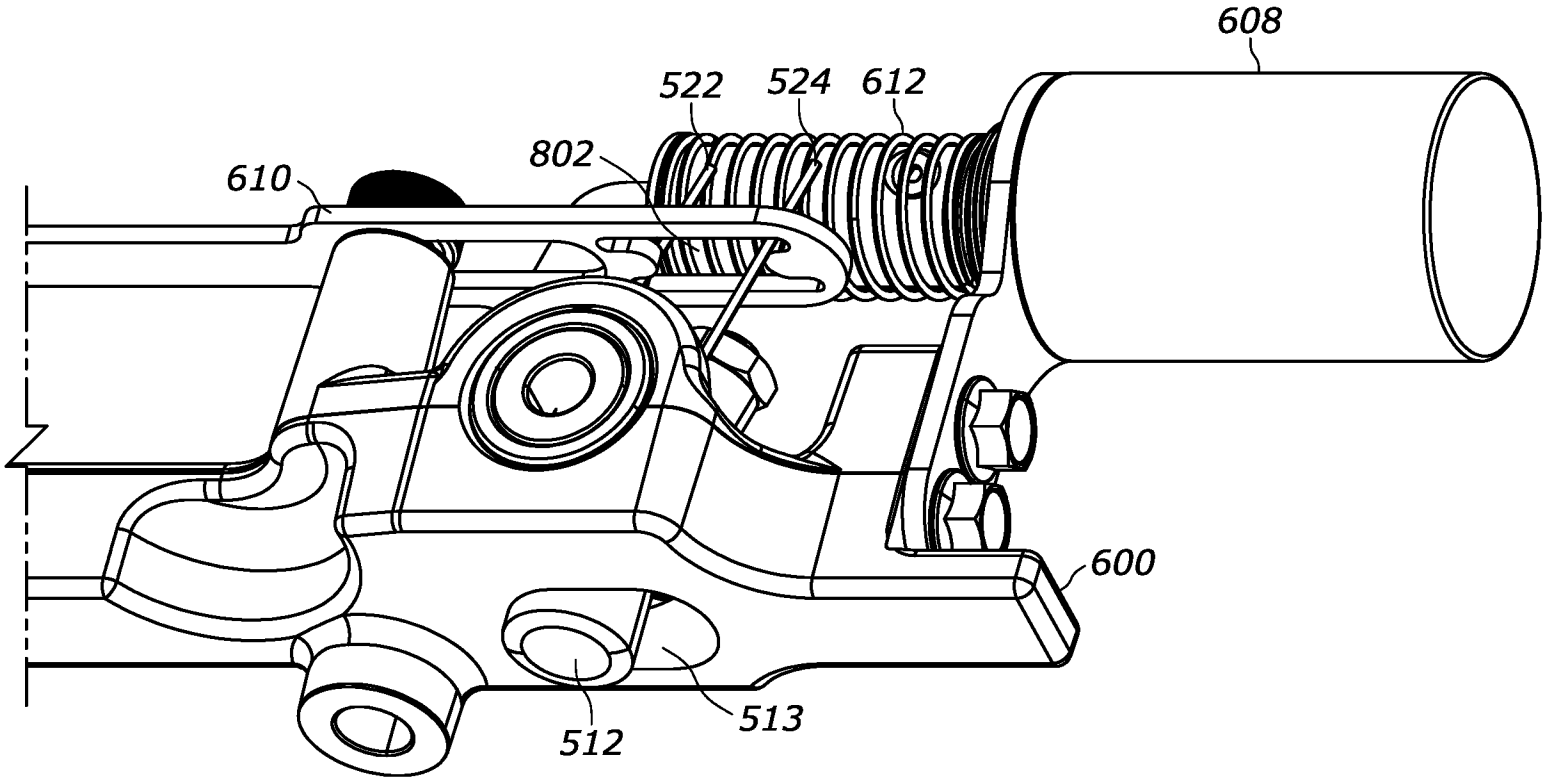
Figure 8:
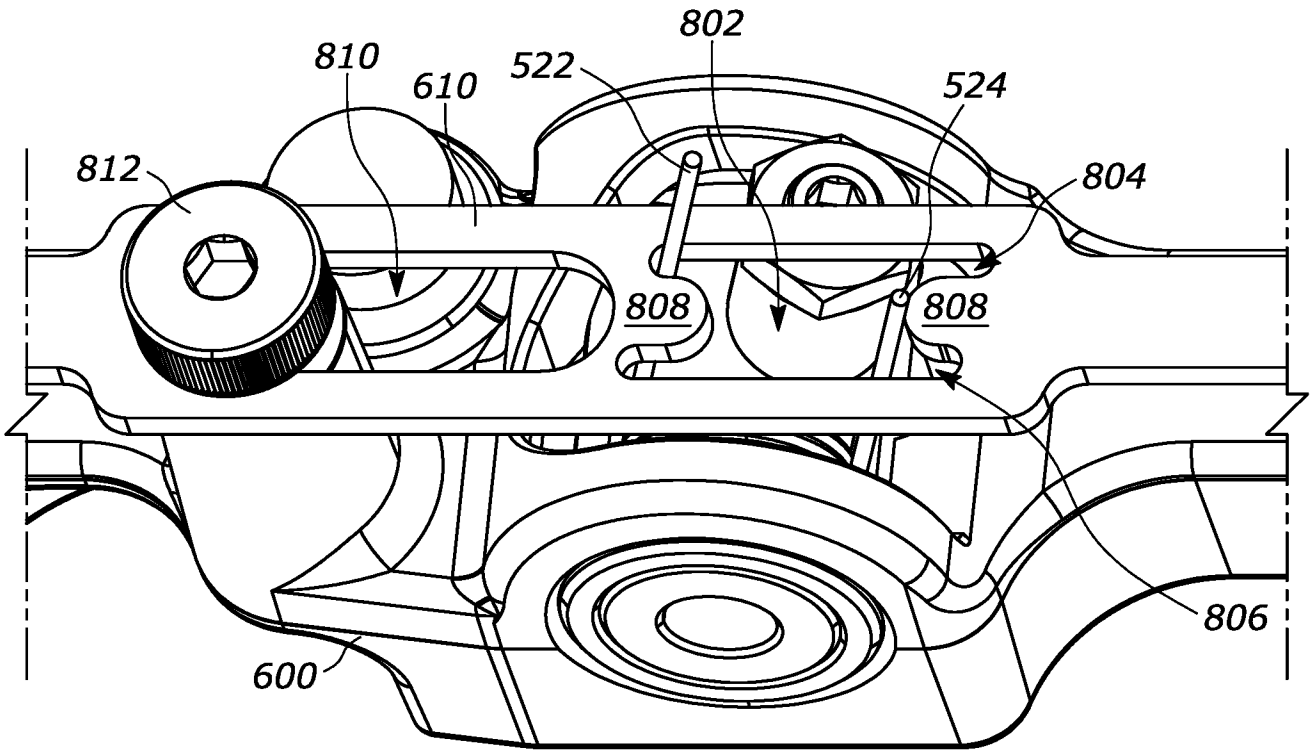

As shown in FIGS. 6 and 8, the rack 610 comprises a plurality of openings 810 slidably secured to the housing 600 by mounting screws 812. Further, as best shown in FIGS. 7 and 8, the legs 522, 524 of each of the torsion spring 520 interact with corresponding slots 802 formed in the rack 610. In a presently preferred embodiment, the slots 802 are implemented in the form of H-slots each comprising first and second longitudinal channels 804, 806 respectively corresponding to the first and second legs 522, 524, where the longitudinal channels 804, 806 are delimited by protrusions 808. In essence, the legs 522, 524 of each torsion spring 520 act as pinions relative to the rack 610, whereby linear displacement of the rack induces rotation of the legs 522, 524. An example of this is illustrated in FIGS. 9A and 9B.

Figure 9A:
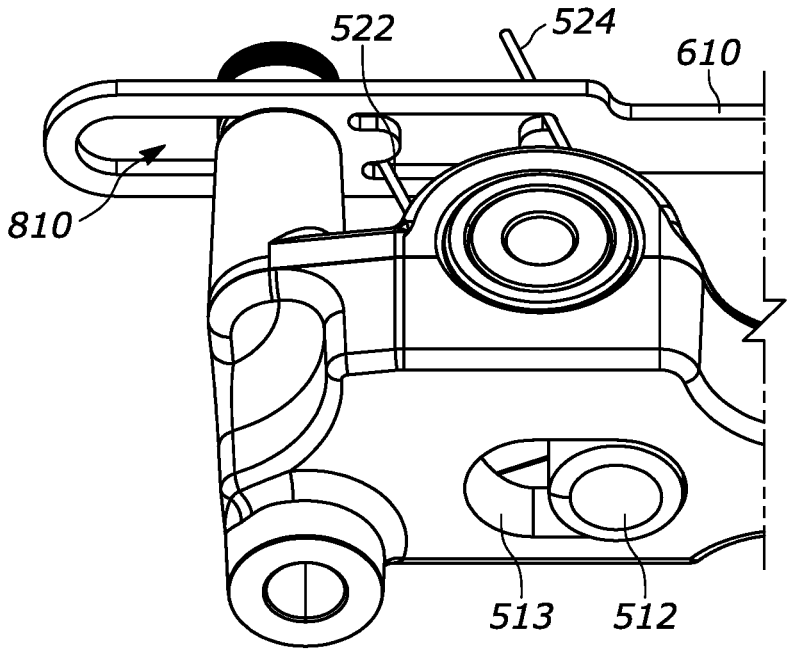

In FIG. 9A, the rack 610 is illustrated in its nominal or starting position, i.e., when biased by the return spring 612 to the maximum leftward distance (as illustrated) permitted by the openings 810. In this case, the H-slot causes the first leg 524 of the torsion spring 520 to be biased leftward as well, thereby causing the swiveling cup 512 to be retracted into the second opening 513 of the housing 600. This condition is further illustrated with reference to FIG. 10A where the bias applied by the rack 610 to the first leg 524 (not shown) causes the pivot body 502 to rotate in a counter-clockwise direction until limited by contact of the swiveling cup 512 with the first stop surface 515 of the second opening 513. In this off/retracted/deactivated state, a lash space is provided between the swiveling cup 512 and an upper surface of the corresponding valve bridge 1002.

Figure 9B:
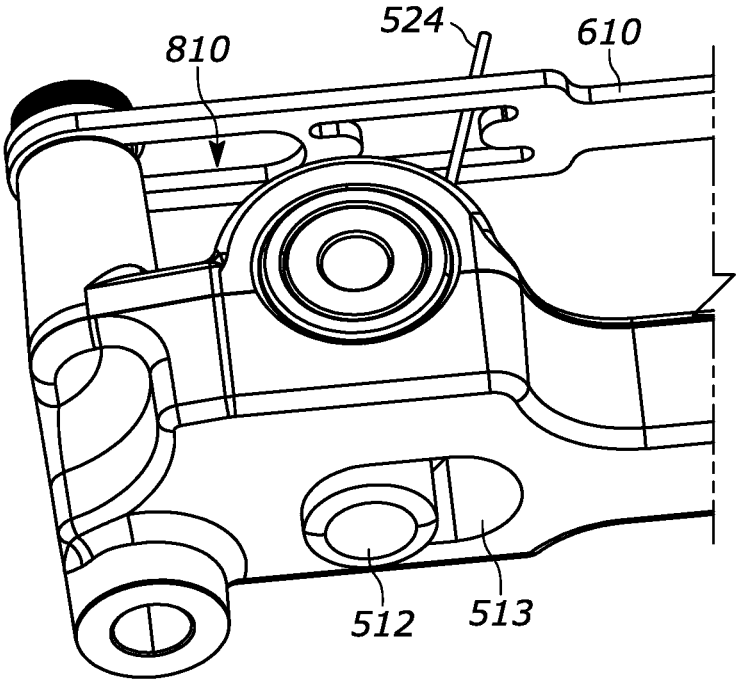
Figure 10A:
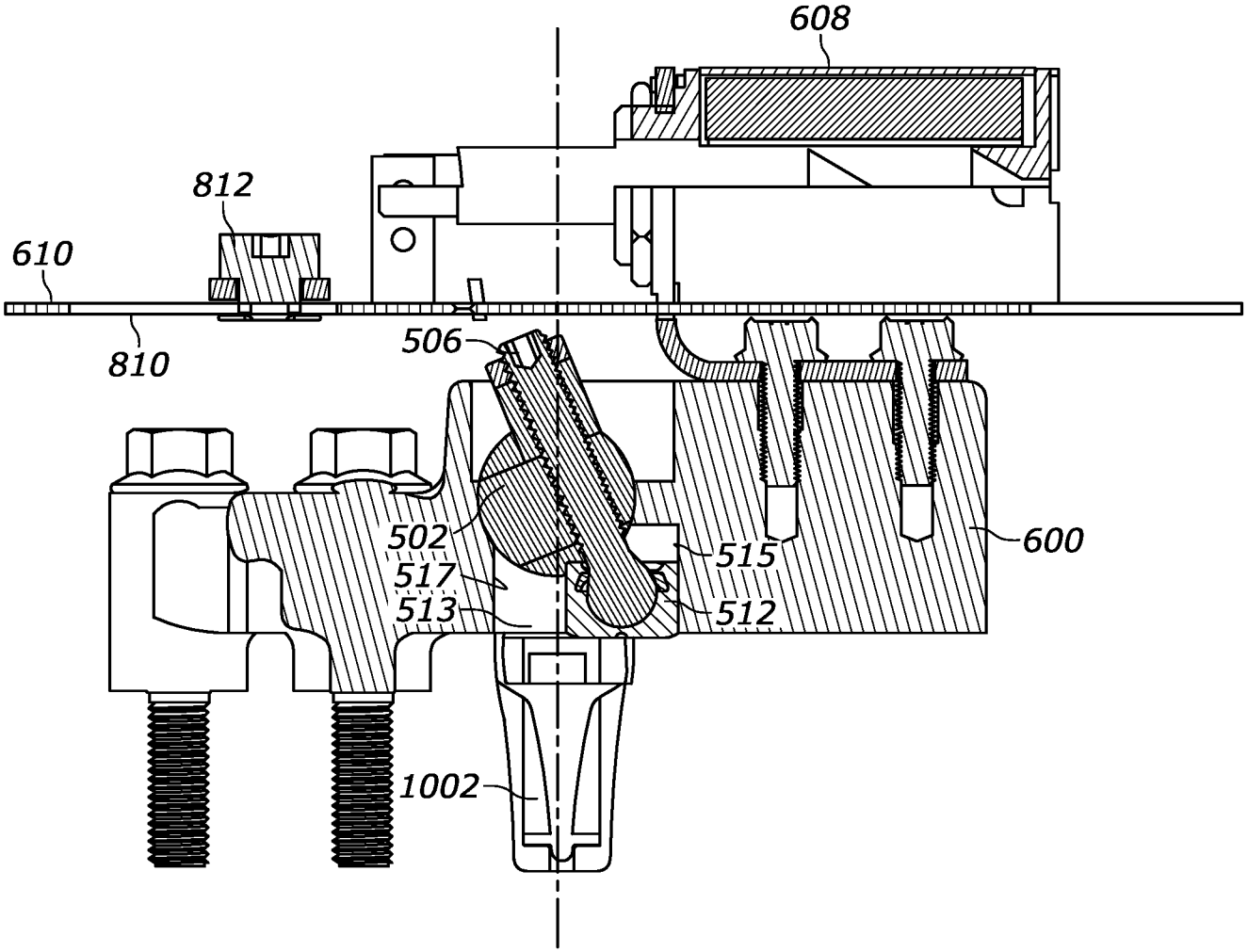
FIGS. 10A-10D are cross-sectional views of a portion of the cylinder decompression system of FIG. 6 illustrating operation of the second embodiment of the rotating actuator of FIGS. 5A and 5B.
Figure 10B:
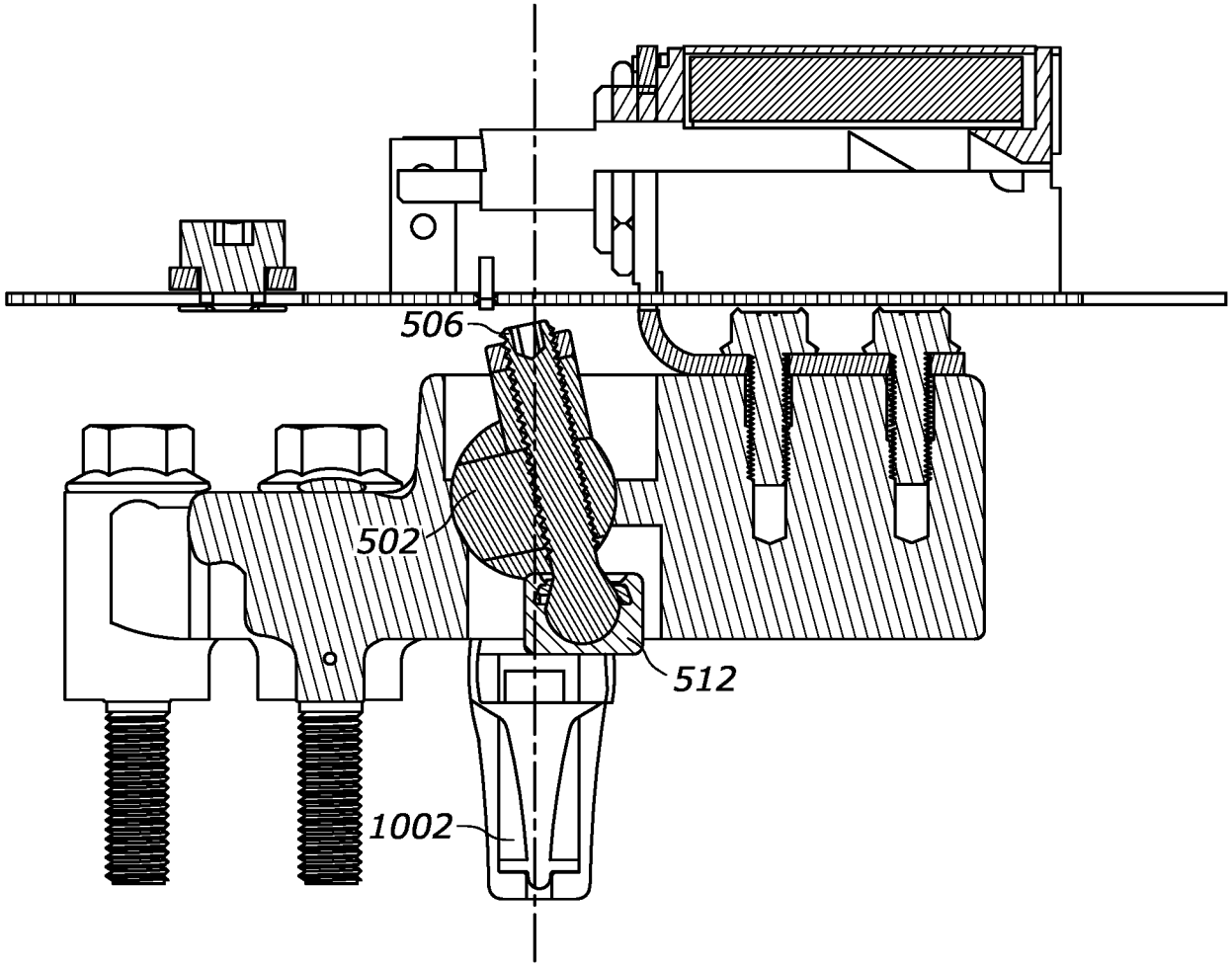
Figure 10C:
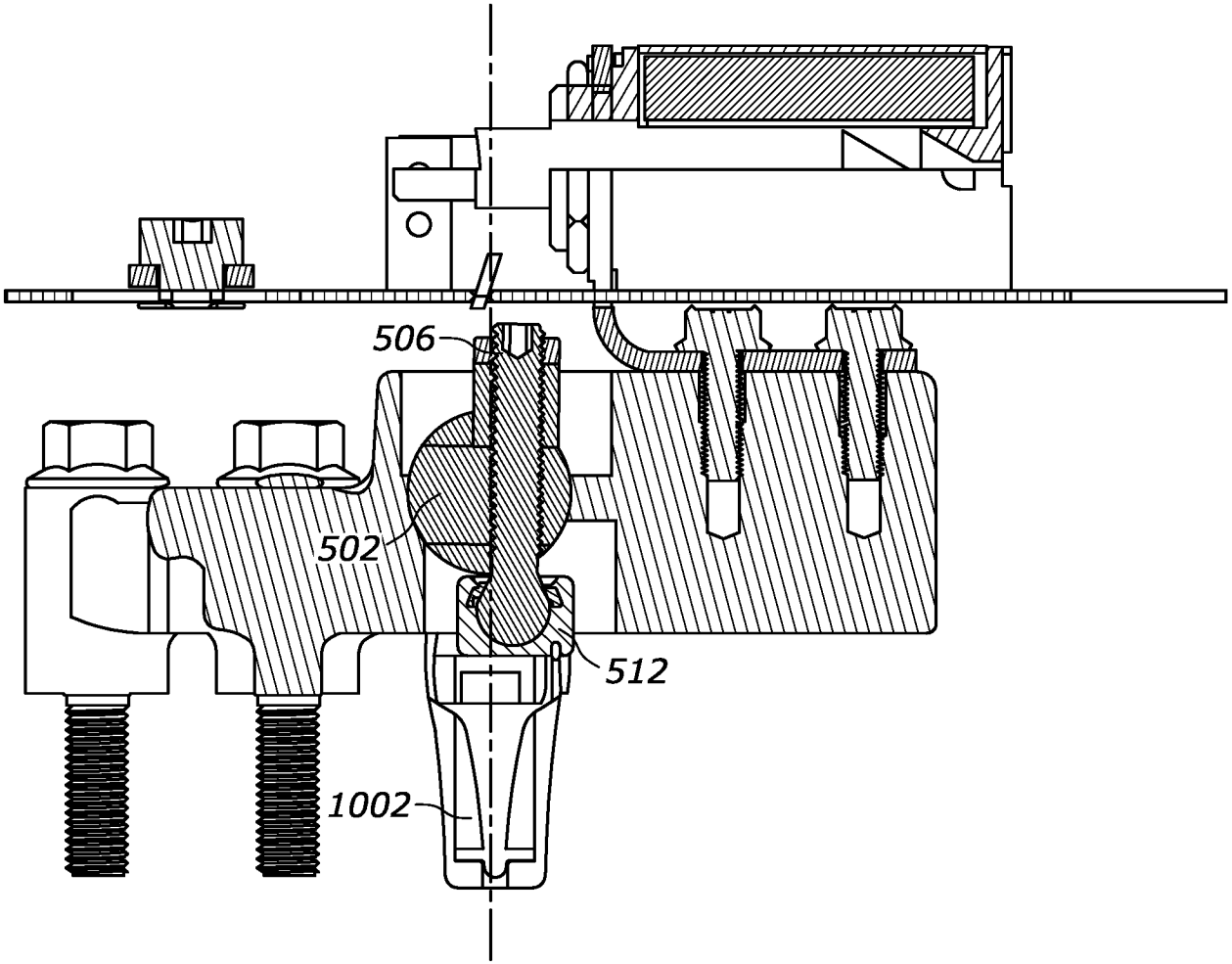

In FIG. 9B, the rack 610 is illustrated in a fully displaced position (maximally displaced rightward as shown) as permitted by the openings 810. In this case, the H-slot causes the second leg 522 of the torsion spring 520 (not visible in FIG. 9B) to be biased rightward as well, thereby causing the swiveling cup 512 to be extended out of the second opening 513 of the housing 600. This condition is further illustrated beginning with reference to FIG. 10B where the bias applied by the rack 610 to the second leg 522 (not shown) causes the pivot body 502 to rotate in a clockwise direction until limited by contact of the swiveling cup 512 with the second stop surface 517 of the second opening 513. In this on/extended/activated state, not only has the lash space between the swiveling cup 512 and valve bridge 1002 from the off/retracted/deactivated state been fully taking up, but the extension of the swiveling cup 512 out of the second opening 513 causes displacement of the valve bridge 1002 to the extent that rotation of the pivot body 502 is not prevented by contact between the swiveling cup 512 and the valve bridge 1002. FIGS. 10B and 10C show various transitional states of the rotating actuator as the rack 610 moves to a fully extended state as shown in FIG. 9B, where it is assumed that the valve bridge 1002 does not obstruct movement of the swiveling cup 512 or rotation of the pivot body 502. In particular, FIG. 10B illustrates a degree of rotation of the pivot body 502 sufficient to initially bring the swiveling cup 512 into contact with the valve bridge 1002, whereas FIG. 10C illustrates a degree of rotation of the pivot body 502 such that the lever arm/lash adjustment screw 506 is in a vertical position and the swiveling cup 512 extends out of the second opening sufficiently to begin downward displacement of the valve bridge 1002.

Figure 10D:
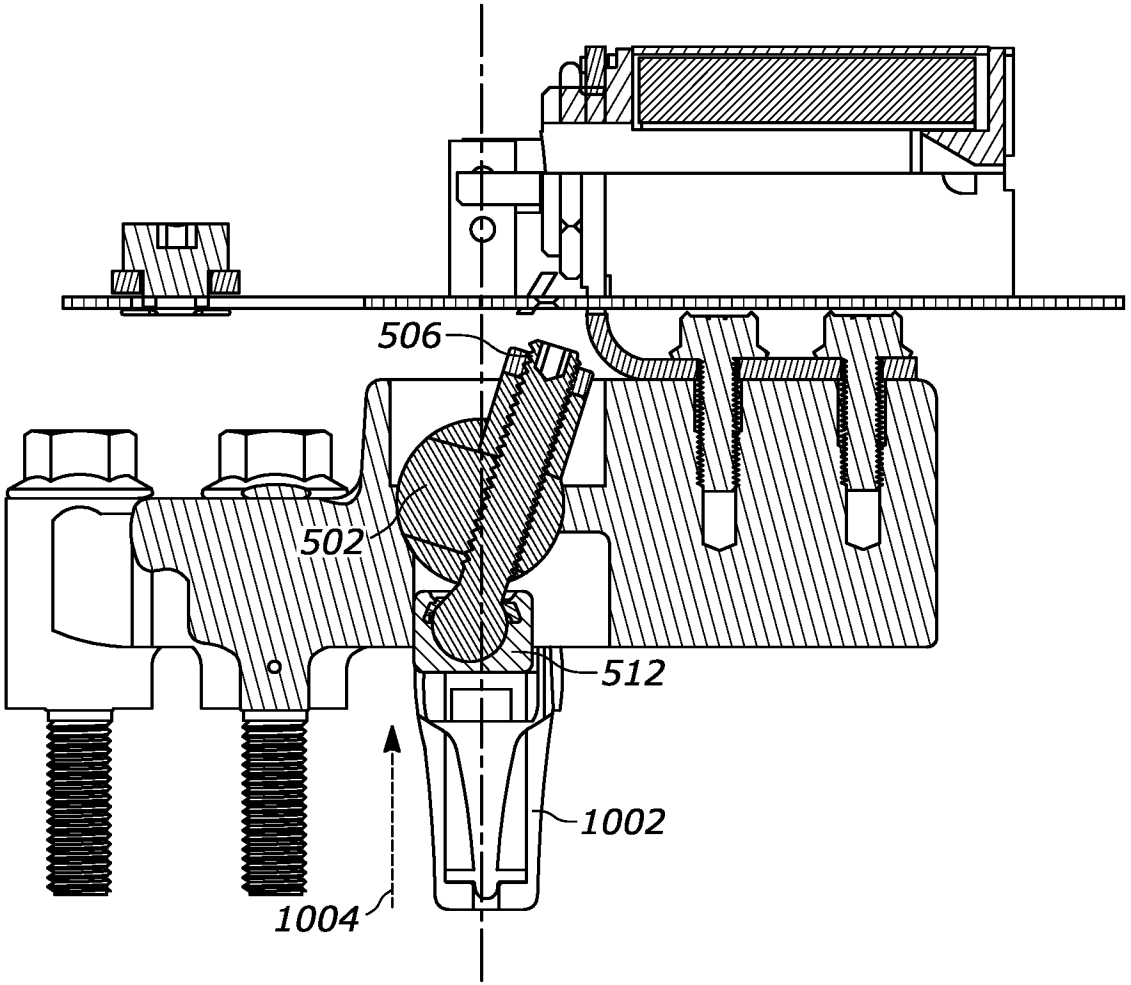

With reference to FIG. 10D, it is observed that the lever arm/lash adjustment screw 506 is rotated past the vertical alignment illustrated in FIG. 10C such that a comparatively large biasing force 1004 applied by the valve springs (not shown) to the valve bridge and lever arm 506 induces a moment in the pivot body 502 sufficient to maintain the swiveling cup 512 in contact with the second stop surface 517. That is, the large biasing force 1004 is stronger than any biasing force that may be applied by the rack 610 to the first leg 524 of the torsion spring 520, which would otherwise be able to induce the counter-clockwise rotation of the pivot body 502 to return the rotating actuators 602-606 to the off/retracted/deactivated state illustrated in FIGS. 9A and 10A.

Figure 11:
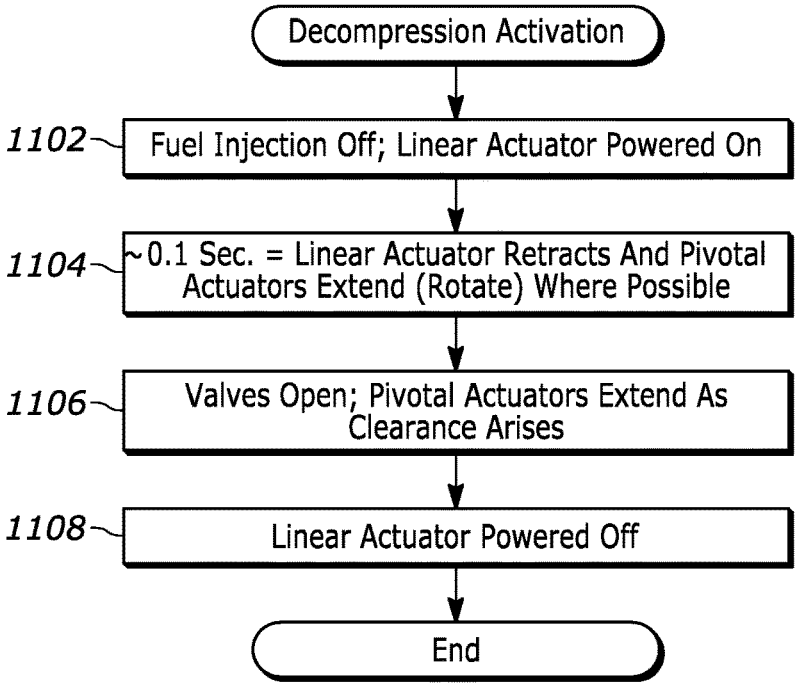
FIG. 11 is a flowchart illustrating decompression activation of the cylinder decompression system of FIG. 6.

Referring now to FIG. 11, a flowchart illustrating decompression activation of the cylinder decompression system of FIG. 4 is shown. The processing illustrated in FIG. 11 is preferably carried out by a suitable processing device operatively connected to the relevant components (e.g., fuel injectors, solenoids, etc.) required to carry out the described functionality. Thus, when it is desired to initiate decompression of cylinders in an internal combustion engine (e.g., at engine shutdown), processing begins at step 1102 where fuel injection to the relevant cylinders is discontinued and the linear actuator 408 energized. In the embodiment illustrated in FIG. 6, energizing the linear actuator 608 causes rightward displacement of the rack 610 and, consequently, retraction of the actuator piston (block 1104). As described above, such movement of the rack 410 will cause engagement of the H-slots with the second leg 522 of each torsion spring 520 of the rotating actuators 602-606 such that the pivot bodies 502 are rotated if free to do so, or the torsion springs 520 are loaded if the pivot bodies 502 are not fee to rotate. This is more fully described with reference to FIGS. 13A-13C.

Figure 13A:
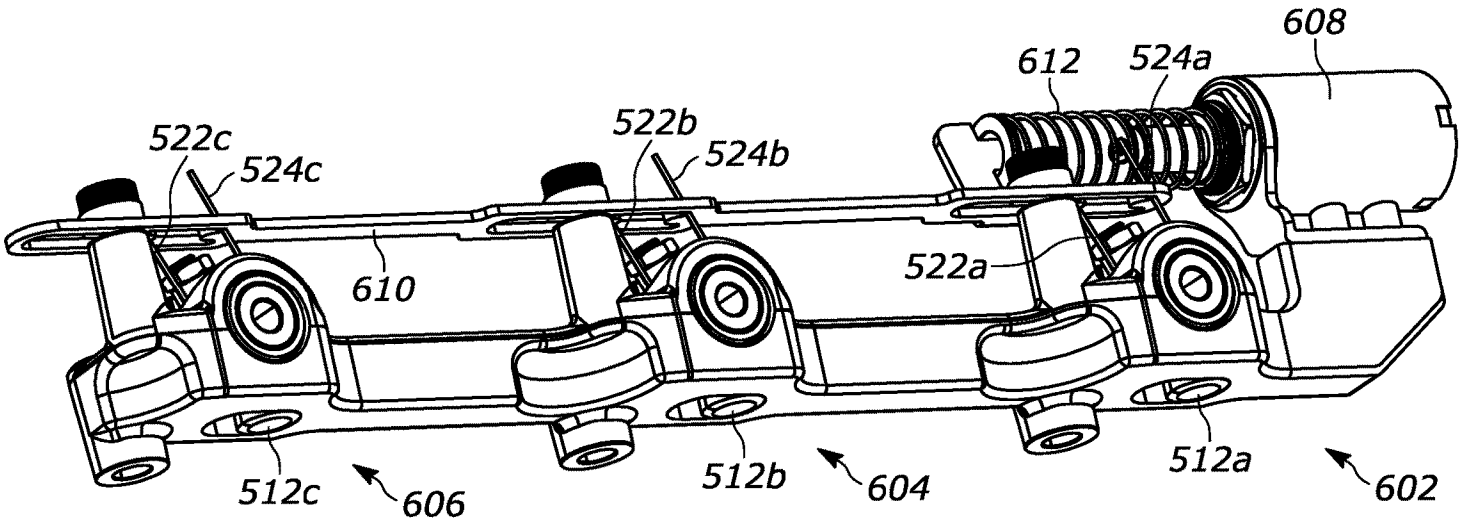
FIGS. 13A-13F are perspective views of the cylinder decompression system of FIG. 6 illustrating various points of operation in accordance with the decompression activation illustrated in FIG. 11.
Figure 13B:
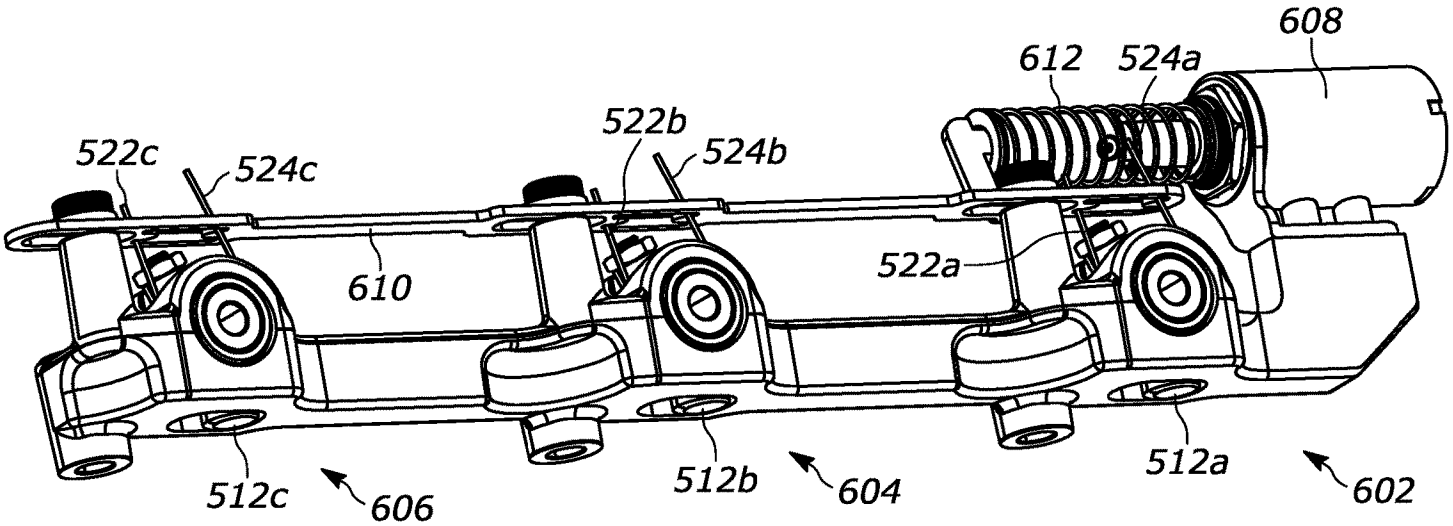
Figure 13C:
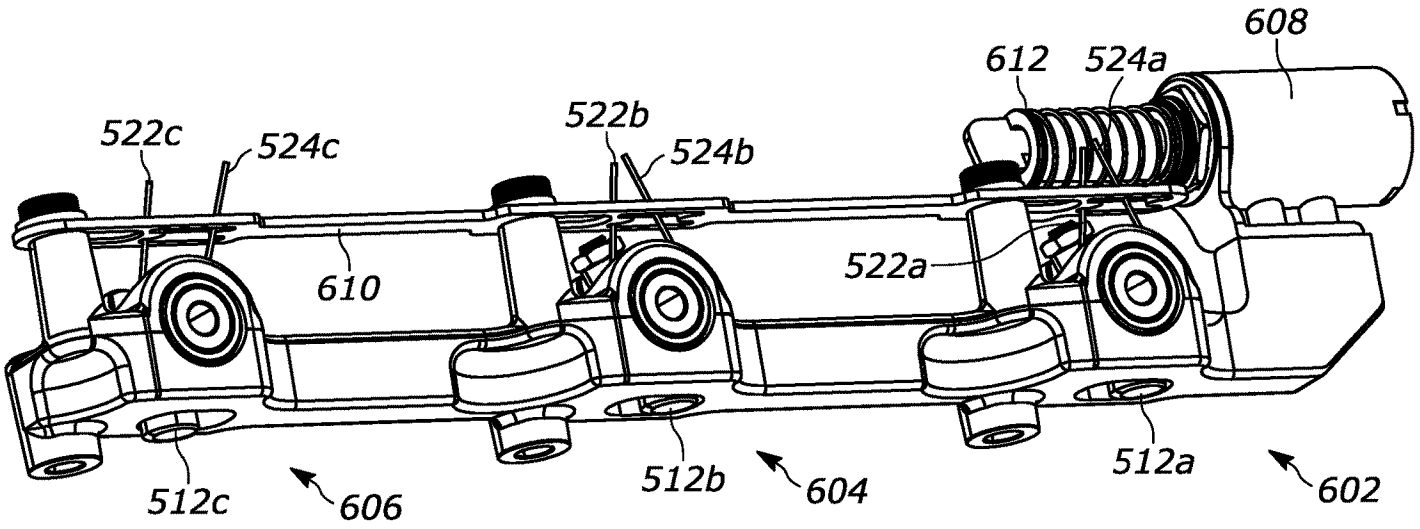

FIG. 13A illustrates the system of FIG. 6 just as the linear actuator 608 is being energized. At this point in time, the swiveling cups 512*a-c* respectively corresponding to first through third rotating actuators 602-606 are retracted, reflecting the off/retracted/deactivated state of the rotating actuators 602-606. In this state, the off/retracted/deactivated state of the rotating actuators 602-606 is further reflected in the fact that each pair of legs 522, 524 corresponding to the rotating actuators 602-606 is rotated counter-clockwise, i.e., the control lever arm provided by each pair of legs 522, 524 causes the pivot bodies 502 to likewise rotate such that the swiveling cups 512*a*, 512*b*, 512*c* are retracted. FIG. 13B illustrates a subsequent point in time when the H-slots in the rack 610 initially engage the second torsion spring legs 522*a*, 522*b*, 522*c* respectively corresponding to first through third rotating actuators 602-606, and FIG. 13C illustrates a further subsequent point in time in which the rack 610 has been fully displaced rightward. The state of the second torsion spring legs 522*a*, 522*b*, 522*c* at the point in time depicted in FIG. 13C will depend on whether the swiveling cups 512*a*, 512*c*, 512*c* are obstructed by their corresponding valve bridges (not shown). For example, as shown in FIG. 13C, it is assumed that the valve bridges corresponding to the first and second rotating actuators 602, 604 are positioned so as to obstruct extension of the corresponding swiveling cups 512*a*, 512*b* (i.e., the valves contacted by those valve bridges are fully closed), whereas it is assumed that the valve bridge corresponding to the third rotating actuator 606 is not positioned so as to obstruct extension of the corresponding swiveling cup 512*c* (i.e., the valves contacted by that valve bridge are at least partially open). As a result, the pivot body 502 of the third rotating actuator 606 is allowed to rotate, thereby causing the swiveling cup 512*c* to extend as shown. Additionally, the second torsion spring leg 522*c* of the third rotating actuator 606 remains unloaded since it is able to rotate along with its corresponding pivot body 502. On the other hand, because the pivot bodies 502 of the first and second rotating actuators 602, 604 are unable to rotate, the first torsion spring legs 522*a*, 522*b* are displaced by the greater force applied thereto by the rack 610, thereby placing a moment upon the corresponding pivot bodies 502.

Referring once again to FIG. 11, at block 1106, the opening of engine valves that were previously closed at block 1104 gives rise to clearance between the corresponding valve bridges and the swiveling cups 512 that were previously obstructed from opening by the valve bridges. This is illustrated with further reference to FIGS. 13D and 13E. At the point in time depicted in FIG. 13D, it is assumed that the valve bridge previously obstructing the swiveling cup 512*a* of the first rotating actuator 602 has been displaced through opening of its corresponding valves. Consequently, as shown, the moment placed on the pivot body 502 of the first rotating actuator 602 by its second torsion spring leg 522*a* is able to cause rotation of the pivot body 502, thereby resulting in extension of the swiveling cup 512*a* and the displacement/unloading of its corresponding torsion spring 520. Similarly, at the point in time depicted in FIG. 13E, it is assumed that the valve bridge previously obstructing the swiveling cup 512*b* of the second rotating actuator 604 has displaced through opening of its corresponding valves. Consequently, as shown, the moment placed on the pivot body 502 of the second rotating actuator 604 by its second torsion spring leg 522*b* is able to cause rotation of the pivot body 502, thereby resulting in extension of the swiveling cup 512*b* and the displacement/unloading of its corresponding torsion spring 520.

Figure 12:
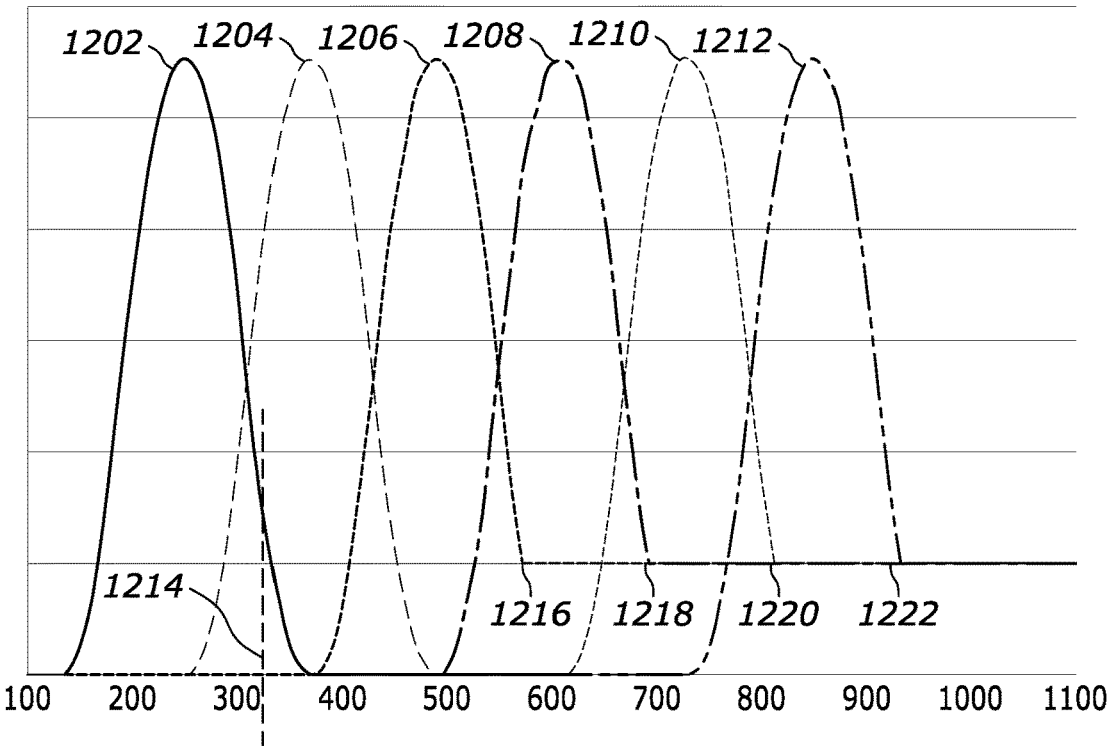
FIG. 12 is a graph illustrating valve lifts for multiple cylinders in accordance with the decompression activation illustrated in FIG. 11.

This sequential turning on/extension/activation of each rotating actuator, and subsequently decompression of engine cylinders through maintenance of engine valves in an open state, is further illustrated with reference to FIG. 12. In particular, FIG. 12 illustrates valve lifts 1202-1212 for six different cylinders of a six-cylinder engine; more specifically, cylinder 1 valve lift 1202, cylinder 4 valve lift 1204, cylinder 2 valve lift 1206, cylinder 6 valve lift 1208, cylinder 3 valve lift 1210 and cylinder 5 valve lift 1212. At a time (crank angle) depicted by the vertical dashed line 1214, the linear actuator 608 is energized as described above at step 1102 of FIG. 11. Thereafter, prior to completion of the cylinder 2 valve lift 1206, the corresponding swiveling cups 512 for each of the cylinders has been fully extended or biased (through a corresponding torsion spring 520) to fully extended at such time that clearance with the valve bridge is provided. This is illustrated in FIG. 12 where closure of the valve for cylinder 2 is prevented 1216 by virtue of the extension of the swiveling cup for that cylinder. Likewise, similar points in time 1218-1222 occur for each of the remain cylinders (not shown for cylinder 1 and cylinder 4) where their corresponding valve bridges are blocked such that the engine valves are not able to completely close, thereby decompressing those cylinders.

Figure 13D:
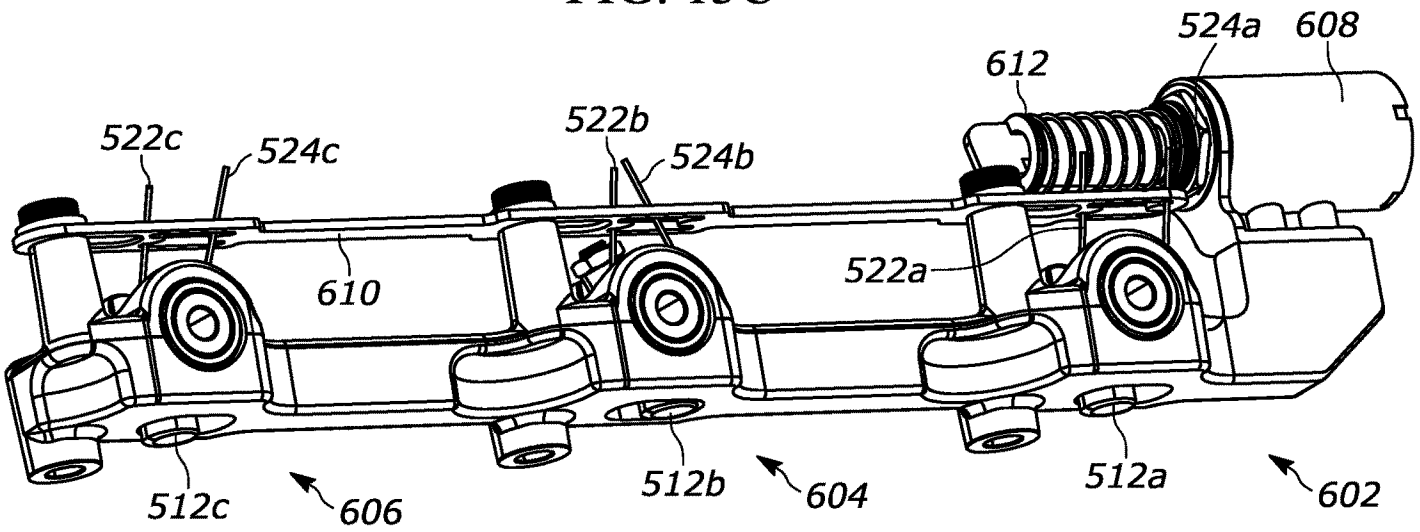
Figure 13E:
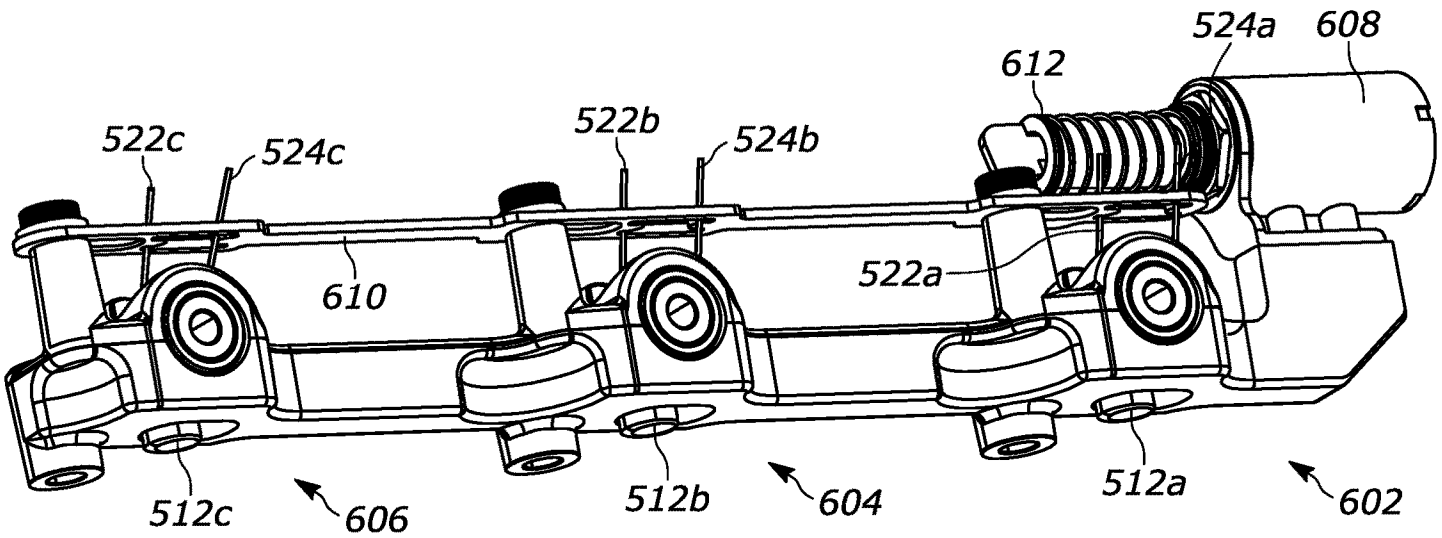

Referring once again to FIG. 11, having fully activated cylinder decompression as described above, processing continues at block 1108 where the linear actuator 608 is de-energized (i.e., turned off or placed in its non-activated state). As a result, no force is provided to maintain the rack 610 in the rightmost position as shown in FIGS. 13C-13E. Consequently, the force applied by the return spring 612 causes the rack 610 to once again be biased leftward until such time that the rack 610 contacts one or more of the first torsion spring legs 524*a*, 524*b*, 524*c* such that torsion from the torsion springs 520 balances the biasing force applied by the return spring 512. The bias applied by the torsion springs 520 against the bias of the return spring 612 induces a counter-clockwise moment in the pivot bodies 502 of the rotating actuators 602-606. However, given the greater, clockwise moment induced in the pivot bodies 502 by the valve springs, the moment induced by the torsion springs 520 is unable to rotate the pivot bodies 602 to the off/deactivated positions. This condition will remain so long as the valve-spring-induced moment on the pivot bodies 502 is present.

Figure 13F:
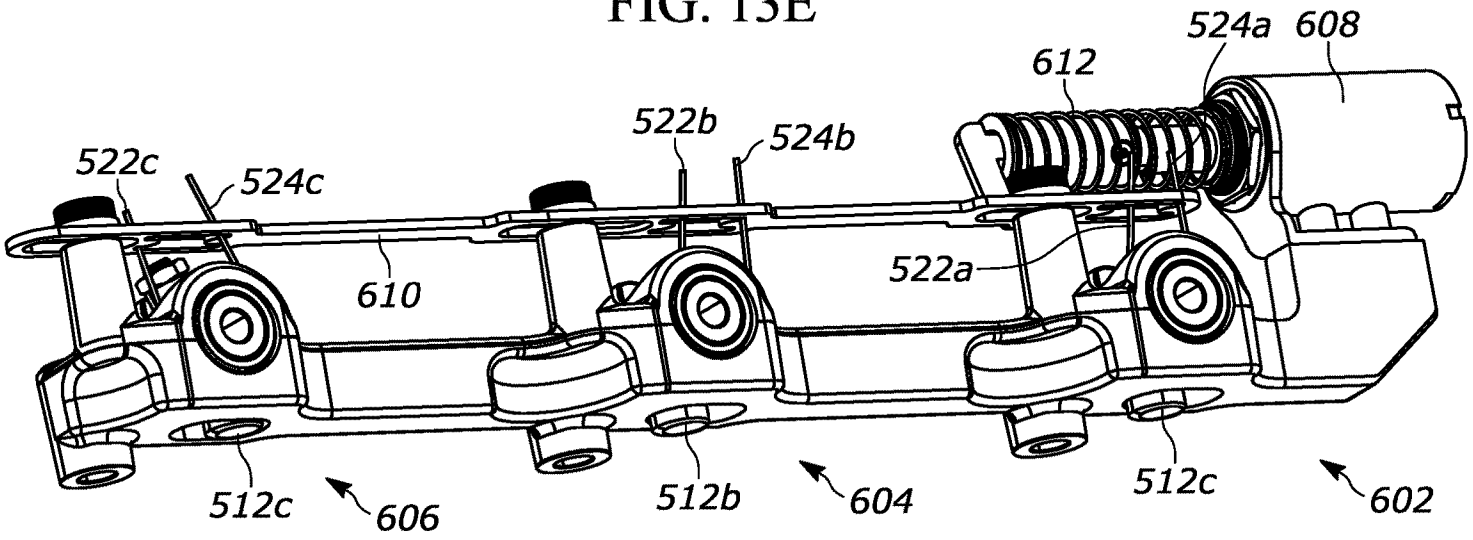
Figure 14:
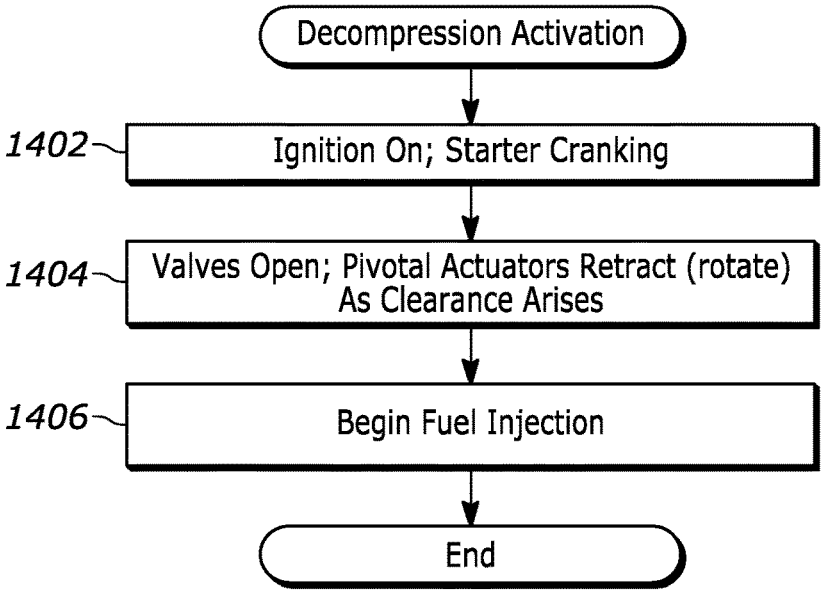
FIG. 14 is a flowchart illustrating decompression deactivation of the cylinder decompression system of FIG. 6.
Figure 15:
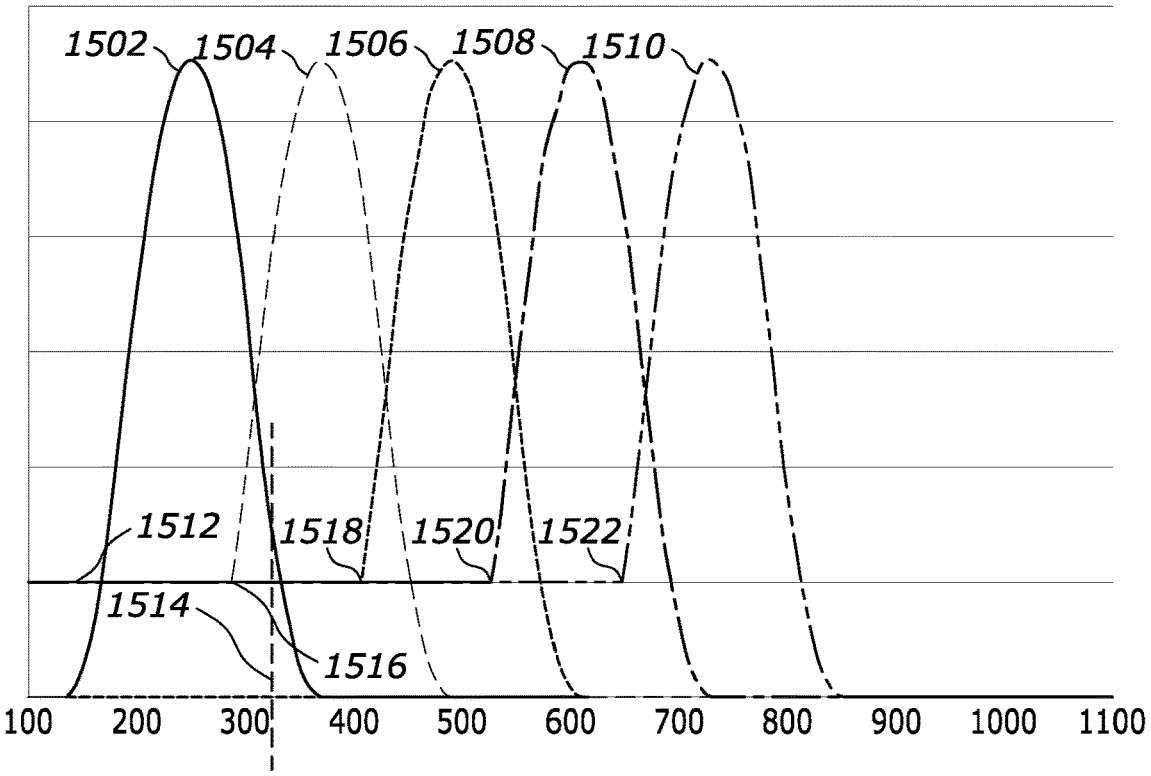
FIG. 15 is a graph illustrating valve lifts for multiple cylinders in accordance with the decompression deactivation illustrated in FIG. 14.

Referring now to FIG. 14, a flowchart illustrating decompression deactivation of the cylinder decompression system of FIG. 6 is shown. Once again, the processing illustrated in FIG. 14 is preferably carried out by a suitable processing device operatively connected to the relevant components (e.g., fuel injectors, solenoids, etc.) required to carry out the described functionality. Thus, when it is desired to discontinue decompression of cylinders in an internal combustion engine (e.g., at engine startup), processing begins at step 1402 where an engine ignition switch (in this example) is turned on, thereby causing the starter motor to begin cranking the engine. Thereafter, at block 1404, as the starter motor cranks the engine, the various engine valves are opened in the usual manner, i.e., rotating cams cause reciprocation of rocker arms that, in turn, reciprocate valve bridges connected to the engine valves. As clearance between the valve bridges and those rotating actuators 602-606 maintained in the on/extended/activated state arises (or, stated otherwise, as the obstacles provided by the valve bridge preventing transition of the rotating actuators 602-606 to the off/retracted/deactivated state are removed), the rotating actuators 602-606 are permitted to transition back into the off/retracted/deactivated state by virtue of the moment induced by the torsion springs 520 following completion of the decompression initiation process (FIG. 13F). This is illustrated in FIG. 15 where, at a point in time 1512 prior to decompression activation, the various valve lifts are maintained at a constant opening height. The illustrated vertical line 1514 indicates a point in time (crank angle) where cranking by the starter motor is initiated. Thereafter, at various points in time 1516-1522, the illustrated valve lifts are performed thereby allowing the rotating actuators 602-606 to rotate back to their retracted positions and allowing each cylinder to resume normal compressed operations.

Referring once again to FIG. 14, having fully deactivated cylinder decompression as described above, processing continues at block 1408 where refueling of the cylinders is resumed.

Figure 1:
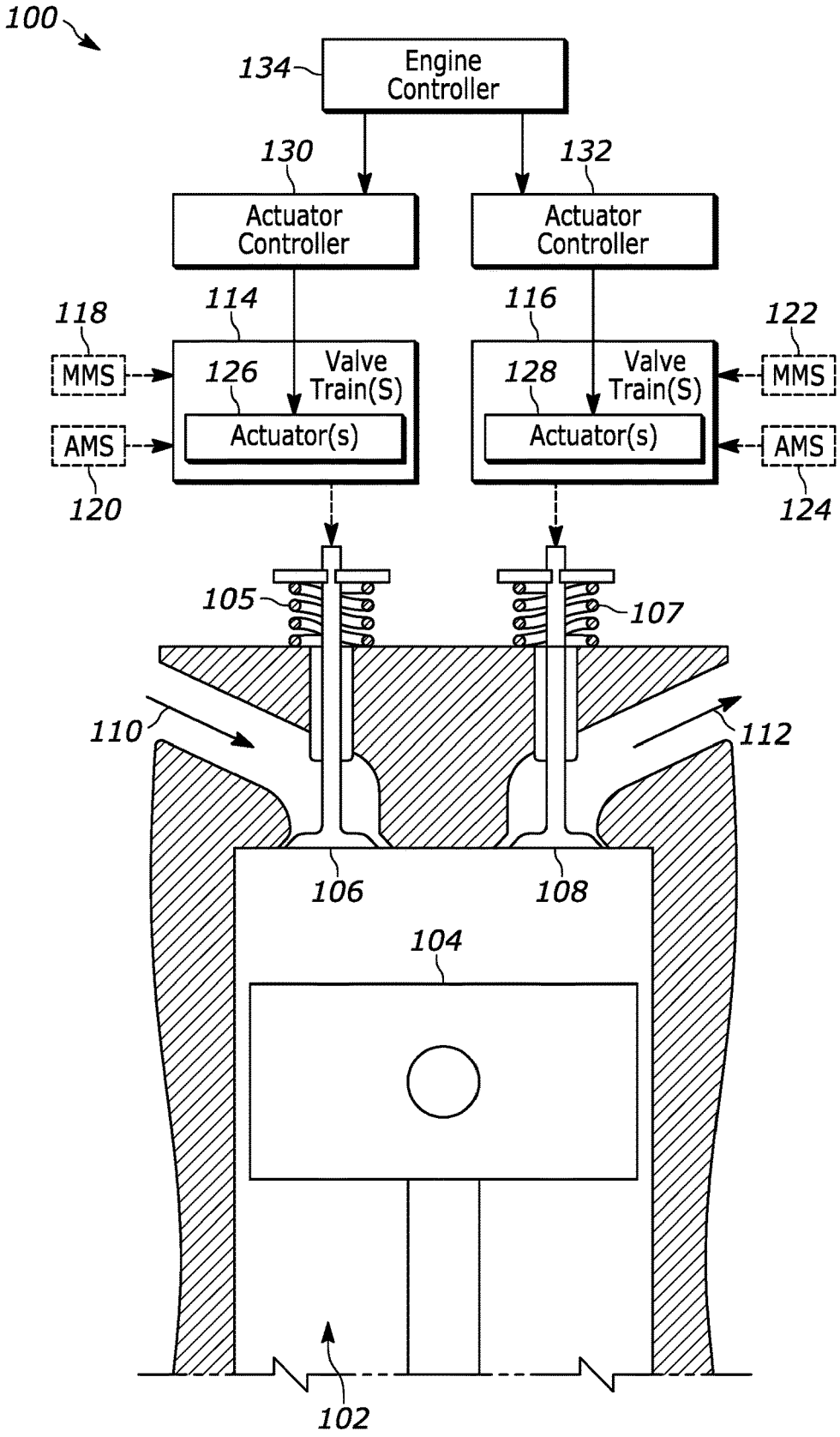
PRIOR ART FIG. 1
FIG. 1 is a schematic, partial cross-sectional illustration of an internal combustion engine illustrating typical deployment of actuators in accordance with prior art techniques.
Figure 2:
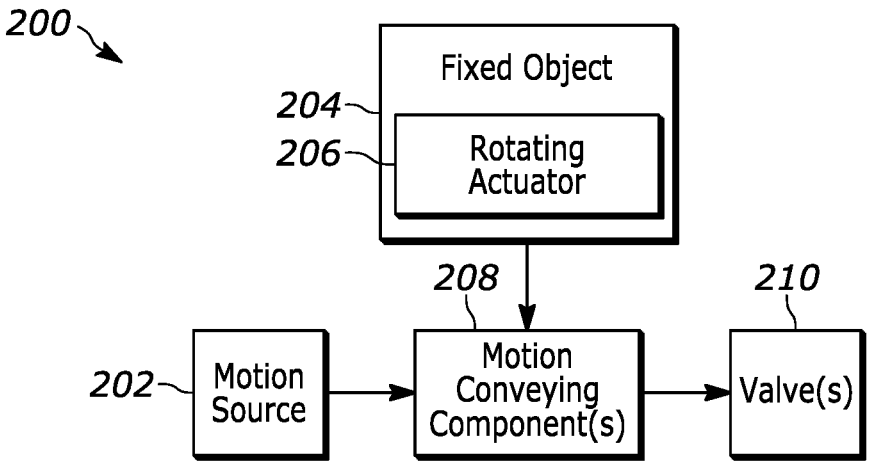
FIG. 2 is a block diagram illustration of an internal combustion engine comprising a rotating actuator system in accordance with prior art techniques.
Figure 16:
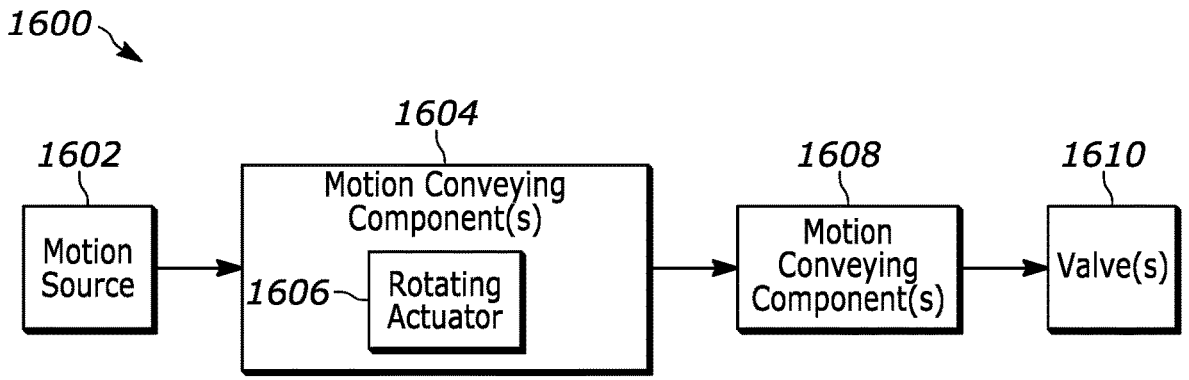
FIG. 16 is a block diagram illustration of an internal combustion engine comprising a rotating actuator system in accordance with an embodiment of the instant disclosure.

As note previously, it is not a requirement that rotating actuators in accordance with the instant disclosure be mounted in a fixed housing, but could instead be mounted in a dynamic housing. An example of this is illustrated in FIG. 16, which schematically illustrates a valvetrain 1600 that is substantially similar to the embodiment of FIG. 2 with the exception that the rotating actuator 1606 is included within a motion conveying component 1604 as shown. For example, the rotating actuator 1606 may be included in a rocker arm, valve bridge, etc. Once again, the rotating actuator 1 06 may be controlled to selectively lose motion originated by the motion source 1602, or to convey that motion to any intervening motion conveying components 1608 and the engine valves 1610.

Figure 17:
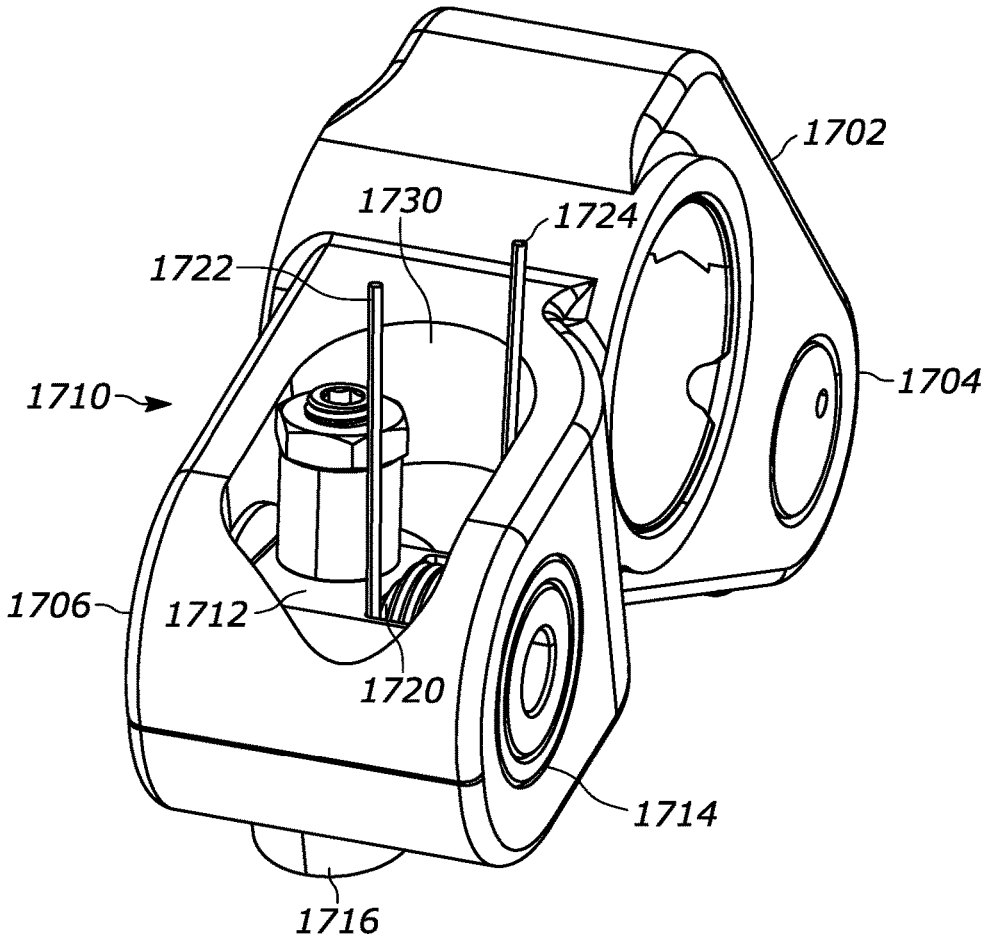
FIG. 17 is a perspective view of a rocker arm in accordance with the embodiment of FIG. 16.

A specific example of a system in accordance with FIG. 16 is further illustrated in FIG. 17, which shows a rocker arm 1702 having a motion receiving end 1704 and a motion imparting end 1706, as known in the art. However, in this case, the rocker arm 1702 further has a rotating actuator 1710, substantially similar to the rotating actuator 500 described above, mounted therein. In particular, the rocker arm 1702 has a transverse bore 1714 formed in the motion imparting end 1706 of the rocker arm 1702 with a pivot body 1712 disposed therein. Also similar to the housing 530 described above, the rocker arm 1702 comprises a first opening 1730 and second opening (not shown) that intersect with the bore 1714 such that components of the rotating actuator 1710 may extend out of the openings. In the illustrated example, this includes legs 1722, 1724 of a torsion spring 1720 extending out of the first opening 1730 and a swivel cup 1716 extending out of the second opening. Though not illustrated in FIG. 17, it will be appreciated that a linear actuator and rack system similar to that depicted in FIG. 6 could be employed to actuate the torsion spring legs 1722, 1724 is a manner to control retraction/extension of the rotating actuator 1710. In this case, however, movement of such a rack would be substantially parallel to a longitudinal axis of the rocker arm 1702. Further, the length of the torsion spring legs 1722, 1724 would need to account for reciprocation of the rocker arm 1702 such that legs 1722, 1724 would not become disengaged from the corresponding rack.

Though specific implementations have been described herein, those skilled in the art will appreciate the various alterations may be employed without departing from the scope of the instant disclosure. For example, though the configuration of the biasing element 612 is such that the rotating actuators 602-606 are normally (i.e., when the linear actuator 608 is deenergized) biased by the rack 610 toward their off/retracted/deactivated position and switched to the on/extended/activated position through operation of the linear actuator 608, this is not a requirement. That is, the biasing element 612 could instead be configured such that the rack 610 normally biases the rotating actuators 602-606 toward their on/extended/activated position and operation of the linear actuator 608 is required to switch them to their off/retracted/deactivated position. Such a configuration may be useful as a form of "safety interlock" such that deactivation of the linear actuator 612 causes decompression (and, thereby, an inability to produce power through the normal combustion cycle) of the relevant cylinders.

What is claimed is:

1. In an internal combustion engine comprising an engine valve and a valve actuation motion source operatively connected to the engine valve by at least one motion conveying component, a system for controlling actuation of the engine valve, the system comprising:

a pivot;

a torsion spring, having first and second legs, operatively connected to the pivot;

a lever arm, adjustably affixed to and extending away from the pivot, rotatable about a pivot axis of the pivot between a retracted position and an extended position and vice versa relative to a motion conveying component of the at least one motion conveying component; and a housing having a pivot bore formed therein and the pivot rotatably disposed in the pivot bore, the housing further comprising a first opening intersecting with the pivot bore and a second opening intersecting with the pivot bore such that the first and second legs extend out of the first opening and the lever arm extends out of the second opening, wherein, in the retracted position, the lever arm has substantially no effect on actuation of the engine valve and, in the extended position, the lever arm is positioned to contact the motion conveying component thereby controlling actuation of the engine valve, and wherein a first force, when applied by the motion conveying component to the lever arm, maintains the lever arm in the extended position.

2. The system of claim 1, further comprising:

a biasing element configured to apply a biasing force to rotate the lever arm to the retracted position, wherein the first force applied by the motion conveying component is sufficient to overcome the biasing force applied by the biasing element.

3. The system of claim 1, the second opening defining a first stop surface and a second stop surface, wherein the first stop surface is configured to delimit the retracted position and the second stop surface is configured to delimit the extended position.

4. The system of claim 3, wherein the second stop surface is configured to position the lever at a non-zero angle relative to a direction of application of the first force.

5. The system of claim 3, wherein the lever arm further comprises a swivel cup disposed on a distal end of the lever arm, wherein the swivel cup is configured to contact the first stop surface when the lever arm is in the retracted position and to contact the second stop surface when the lever arm is in the extended position.

6. The system of claim 1, wherein the first force is a closing force applied by an engine valve spring to the engine valve and, thereby, the motion conveying component.

7. The system of claim 1, further comprising:

a linear actuator having an activated state and a non-activated state;

a sliding rack slidably mounted on a fixed housing and operatively connected to the linear actuator; and a biasing element configured to bias the sliding rack to a starting position when the linear actuator is in the non-activated state, wherein the sliding rack moves to a fully displaced position, against the bias of the biasing element, when the linear actuator is in the activated state, and wherein the first and second legs of the torsion spring are configured to intersect a slot formed in the sliding rack where:

in the starting position and when the first force is not applied by the motion conveying component to the lever arm, the slot engages the first leg of the torsion spring and positions the lever arm in the retracted position, in the starting position and when the first force is applied by the motion conveying component to the lever arm, the slot induces a load in the first leg of the torsion spring to position the lever arm in the retracted position once the first force is removed from the lever arm, in the fully displaced position and when the first force is not applied by the motion conveying component to the lever arm, the slot engages the second leg of the torsion spring and positions the lever arm in the extended position, and in the fully displaced position and when the first force is applied by the motion conveying component to the lever arm, the slot induces a load in the second leg of the torsion spring to position the lever arm in the extended position once the first force is removed from the lever arm.

8. The system of claim 7, wherein the biasing element is a spring disposed between the linear actuator and the sliding rack.

9. The system of claim 7, wherein the slot in the sliding rack is an H-slot having first and second longitudinal channels, wherein the first leg of the torsion spring intersects the first longitudinal channel and the second leg of the torsional spring intersects the second longitudinal channel.

10. The system of claim 1, wherein the housing is fixed relative to movement of the motion conveying component.

11. The system of claim 1, wherein the housing is provided by another motion conveying component of the at least one motion conveying component.

* * * * *